US012082758B2

(12) United States Patent
Williams et al.

(10) Patent No.: US 12,082,758 B2
(45) Date of Patent: Sep. 10, 2024

(54) CLEANING PAD FOR CLEANING ROBOT

(71) Applicant: Robot Corporation, Bedford, MA (US)

(72) Inventors: Marcus Williams, Watertown, MA (US); Lin Lung Chieh, Tainan (TW)

(73) Assignee: iRobot Corporation, Bedford, MA (US)

( * ) Notice: Subject to any disclaimer, the term of this patent is extended or adjusted under 35 U.S.C. 154(b) by 0 days.

(21) Appl. No.: 18/079,351

(22) Filed: Dec. 12, 2022

(65) Prior Publication Data

US 2023/0111703 A1 Apr. 13, 2023

Related U.S. Application Data

(63) Continuation of application No. 16/827,416, filed on Mar. 23, 2020, now Pat. No. 11,571,104, which is a continuation of application No. 15/612,234, filed on Jun. 2, 2017, now Pat. No. 10,595,698.

(51) Int. Cl.
*A47L 11/40* (2006.01)
*A47L 13/16* (2006.01)

(52) U.S. Cl.
CPC ..... *A47L 11/4088* (2013.01); *A47L 11/4036* (2013.01); *A47L 13/16* (2013.01); *A47L 2201/00* (2013.01)

(58) Field of Classification Search
CPC .. A47L 11/4036; A47L 11/4088; A47L 13/16; A47L 2201/00
See application file for complete search history.

(56) References Cited

U.S. PATENT DOCUMENTS 1,724,267 A * 8/1929 Field ..... A47L 13/16 15/210.1
3,729,041 A 4/1973 Kubota
4,319,379 A 3/1982 Carrigan et al.
(Continued)

FOREIGN PATENT DOCUMENTS

CN 1178737 4/1998
CN 1367674 9/2002
(Continued)

OTHER PUBLICATIONS

TW-M538776-U—English Machine Translation (Year: 2017).*
(Continued)

*Primary Examiner* — Marc Carlson
(74) *Attorney, Agent, or Firm* — Fish & Richardson P.C.

(57) ABSTRACT

A cleaning pad for an autonomous cleaning robot evenly wets and collects debris for cleaning operations. The pad includes a core of absorbent layers for absorbing liquid through capillary action and for distributing the liquid within the cleaning pad. The pad includes a wrap layer around the core, the wrap layer comprising a fibrous layer that is flexible and absorbent, the fibrous layer configured to absorb liquid through capillary action and transfer the liquid to the core. The pad includes one or more transition regions spanning a cleaning width of the cleaning pad, the one or more transition regions dividing the cleaning pad into at least two segments. The forward positioned segment of the pad, of the at least two segments of the pad, has a lesser thickness compared to a thickness of an aft positioned segment of the at least two segments.

28 Claims, 8 Drawing Sheets

(56) References Cited

U.S. PATENT DOCUMENTS 4,967,862 A 11/1990 Pong et al.
5,440,216 A 8/1995 Kim
5,609,255 A 3/1997 Nichols
5,630,243 A 5/1997 Federico et al.
5,720,077 A 2/1998 Nakamura et al.
5,787,545 A 8/1998 Colens
5,815,880 A 10/1998 Nakanishi
5,841,259 A 11/1998 Kim et al.
5,894,621 A 4/1999 Kubo
5,940,927 A 8/1999 Haegermarck et al.
5,959,423 A 9/1999 Nakanishi et al.
5,991,951 A 11/1999 Kubo et al.
5,998,953 A 12/1999 Nakamura et al.
6,012,618 A 1/2000 Matsuo
6,076,025 A 6/2000 Ueno et al.
6,101,661 A 8/2000 Policicchio
6,119,057 A 9/2000 Kawagoe
6,142,252 A 11/2000 Kinto et al.
6,327,741 B1 12/2001 Reed
6,338,013 B1 1/2002 Ruffner
6,389,329 B1 5/2002 Colens
6,459,955 B1 10/2002 Bartsch et al.
6,481,515 B1 11/2002 Kirkpatrick et al.
6,491,998 B1 12/2002 Heitz
6,532,404 B2 3/2003 Colens
6,580,246 B2 6/2003 Jacobs
6,594,844 B2 7/2003 Jones
6,600,981 B2 7/2003 Ruffner
6,690,134 B1 2/2004 Jones et al.
6,741,054 B2 5/2004 Koselka et al.
6,771,217 B1 8/2004 Liu et al.
6,779,217 B2 8/2004 Fisher
6,781,338 B2 8/2004 Jones et al.
6,809,490 B2 10/2004 Jones et al.
6,868,307 B2 3/2005 Song et al.
6,883,201 B2 4/2005 Jones et al.
6,901,624 B2 6/2005 Mori et al.
6,938,298 B2 9/2005 Aasen
6,965,209 B2 11/2005 Jones et al.
6,996,871 B1 2/2006 Policicchio
7,013,527 B2 3/2006 Thomas et al.
7,013,528 B2 3/2006 Parker et al.
7,015,831 B2 3/2006 Karlsson et al.
7,113,847 B2 9/2006 Chmura et al.
7,135,992 B2 11/2006 Karlsson et al.
7,137,169 B2 11/2006 Murphy et al.
7,145,478 B2 12/2006 Goncalves et al.
7,155,308 B2 12/2006 Jones
7,162,338 B2 1/2007 Goncalves et al.
7,173,391 B2 2/2007 Jones et al.
7,177,737 B2 2/2007 Karlsson et al.
7,196,487 B2 3/2007 Jones et al.
7,248,951 B2 7/2007 Hulden
7,272,467 B2 9/2007 Goncalves et al.
7,288,912 B2 10/2007 Landry et al.
7,320,149 B1 1/2008 Huffman et al.
7,346,428 B1 3/2008 Huffman et al.
7,388,343 B2 6/2008 Jones et al.
7,389,156 B2 6/2008 Ziegler et al.
7,448,113 B2 11/2008 Jones et al.
7,480,958 B2 1/2009 Song et al.
7,539,557 B2 5/2009 Yamauchi
7,571,511 B2 8/2009 Jones et al.
7,620,476 B2 11/2009 Ziegler et al.
7,636,982 B2 12/2009 Jones et al.
7,761,954 B2 7/2010 Ziegler et al.
7,832,048 B2 11/2010 Harwig et al.
7,891,898 B2 2/2011 Hoadley et al.
8,087,121 B1 * 1/2012 Michelson ..... A47L 13/14 15/228
8,387,193 B2 3/2013 Ziegler et al.
8,670,866 B2 3/2014 Ziegler et al.
8,692,695 B2 4/2014 Fallon et al.
8,739,355 B2 6/2014 Ziegler et al.
8,774,966 B2 7/2014 Ziegler et al.
8,782,848 B2 7/2014 Ziegler et al.
8,855,813 B2 10/2014 Ziegler et al.
8,892,251 B1 * 11/2014 Dooley ..... A47L 11/4011 700/245
8,931,971 B2 1/2015 Schwarz et al.
8,961,695 B2 * 2/2015 Romanov ..... A47L 11/4011 15/340.1
8,966,707 B2 3/2015 Ziegler et al.
9,220,389 B2 12/2015 Dooley et al.
9,259,285 B2 2/2016 Dunn
9,265,396 B1 2/2016 Lu et al.
9,320,409 B1 * 4/2016 Lu ..... A47L 9/2815
9,565,984 B2 2/2017 Lu et al.
10,595,698 B2 3/2020 Williams
10,791,902 B2 * 10/2020 Reimels ..... A47L 11/28
11,284,766 B2 * 3/2022 Jang ..... A47L 9/2852
11,571,104 B2 2/2023 Williams et al.
2002/0002751 A1 1/2002 Fisher
2002/0011813 A1 1/2002 Koselka et al.
2002/0016649 A1 2/2002 Jones
2002/0083964 A1 7/2002 McKay
2002/0120364 A1 8/2002 Colens
2002/0175648 A1 11/2002 Erko et al.
2003/0025472 A1 2/2003 Jones et al.
2003/0028985 A1 2/2003 Prodoehl et al.
2003/0229421 A1 12/2003 Chmura et al.
2004/0020000 A1 2/2004 Jones
2004/0031113 A1 * 2/2004 Wosewick ..... A47L 13/20 15/340.1
2004/0049877 A1 3/2004 Jones et al.
2004/0128786 A1 * 7/2004 Policicchio ..... A47L 13/22 15/228
2004/0143930 A1 7/2004 Haegermarck
2004/0158357 A1 8/2004 Lee et al.
2004/0187457 A1 9/2004 Colens
2004/0207355 A1 10/2004 Jones et al.
2004/0244138 A1 12/2004 Taylor et al.
2005/0010331 A1 1/2005 Taylor et al.
2005/0028316 A1 2/2005 Thomas et al.
2005/0053912 A1 3/2005 Roth et al.
2005/0067994 A1 3/2005 Jones et al.
2005/0155631 A1 7/2005 Kilkenny et al.
2005/0204717 A1 9/2005 Colens
2005/0209736 A1 9/2005 Kawagoe
2005/0217061 A1 10/2005 Reindle
2005/0229340 A1 10/2005 Sawalski et al.
2005/0229344 A1 10/2005 Mittelstaedt et al.
2005/0278888 A1 12/2005 Reindle et al.
2006/0009879 A1 1/2006 Lynch et al.
2006/0048319 A1 3/2006 Morgan et al.
2006/0085095 A1 4/2006 Reindle et al.
2006/0123587 A1 6/2006 Parr et al.
2006/0135026 A1 6/2006 Arendt et al.
2006/0140703 A1 6/2006 Sacks
2006/0185690 A1 8/2006 Song et al.
2006/0190134 A1 8/2006 Ziegler et al.
2006/0200281 A1 9/2006 Ziegler et al.
2006/0207053 A1 9/2006 Beynon
2006/0241812 A1 10/2006 Jung
2006/0288519 A1 12/2006 Jaworski et al.
2006/0293794 A1 12/2006 Harwig et al.
2006/0293809 A1 12/2006 Harwig et al.
2007/0016328 A1 1/2007 Ziegler et al.
2007/0044821 A1 3/2007 Bertram et al.
2007/0061040 A1 3/2007 Augenbraun et al.
2007/0094836 A1 5/2007 Sepke et al.
2007/0226943 A1 10/2007 Lenkiewicz et al.
2007/0234492 A1 10/2007 Svendsen et al.
2007/0266508 A1 11/2007 Jones et al.
2008/0039974 A1 2/2008 Sandin et al.
2008/0104783 A1 5/2008 CraVvford et al.
2008/0109126 A1 5/2008 Sandin et al.
2008/0127446 A1 6/2008 Ziegler et al.
2008/0140255 A1 6/2008 Ziegler et al.
2008/0155768 A1 7/2008 Ziegler et al.
2008/0188984 A1 8/2008 Harwig et al.
2008/0244846 A1 10/2008 Bayon et al.
2008/0307590 A1 12/2008 Jones et al.
2009/0133720 A1 5/2009 Van Den Bogert

(56) References Cited

U.S. PATENT DOCUMENTS

| | | | | |
|---|---|---|---|---|
| 2009/0281661 | A1* | 11/2009 | Dooley | B60L 15/2036 901/1 |
| 2009/0306822 | A1 | 12/2009 | Augenbraun et al. | |
| 2010/0049365 | A1 | 2/2010 | Jones et al. | |
| 2010/0203306 | A1 | 8/2010 | Fingal et al. | |
| 2010/0223748 | A1 | 9/2010 | Lowe et al. | |
| 2010/0257690 | A1 | 10/2010 | Jones et al. | |
| 2010/0257691 | A1 | 10/2010 | Jones et al. | |
| 2010/0263158 | A1 | 10/2010 | Jones et al. | |
| 2011/0077802 | A1 | 3/2011 | Halloran et al. | |
| 2011/0160903 | A1 | 6/2011 | Romanov et al. | |
| 2011/0162157 | A1 | 7/2011 | Dooley et al. | |
| 2011/0202175 | A1 | 8/2011 | Romanov et al. | |
| 2013/0000066 | A1 | 1/2013 | Skelton | |
| 2013/0242613 | A1 | 9/2013 | Kurata et al. | |
| 2014/0259511 | A1 | 9/2014 | Ziegler et al. | |
| 2014/0289992 | A1 | 10/2014 | Ziegler et al. | |
| 2014/0331431 | A1* | 11/2014 | Ludtke | A47L 13/31 15/209.1 |
| 2015/0128364 | A1* | 5/2015 | Dooley | A47L 13/16 15/98 |
| 2015/0128996 | A1 | 5/2015 | Dooley et al. | |
| 2016/0242613 | A1 | 8/2016 | Dooley et al. | |
| 2016/0270618 | A1* | 9/2016 | Lu | A47L 11/4061 |
| 2017/0100010 | A1 | 4/2017 | Lu et al. | |
| 2018/0000306 | A1* | 1/2018 | Caruso | A47L 11/4061 |
| 2018/0140154 | A1* | 5/2018 | Tai | A47L 11/28 |
| 2018/0344117 | A1* | 12/2018 | Williams | A47L 11/4088 |
| 2019/0210409 | A1* | 7/2019 | Grace | A47L 11/28 |
| 2020/0214528 | A1* | 7/2020 | Williams | A47L 11/4036 |

FOREIGN PATENT DOCUMENTS

| | | | | |
|---|---|---|---|---|
| CN | 1486155 | | 3/2004 | |
| CN | 1863477 | | 11/2006 | |
| CN | 103072412 | | 5/2013 | |
| CN | 205227439 | | 5/2016 | |
| CN | 106108793 | | 11/2016 | |
| CN | 108078511 | | 5/2018 | |
| CN | 105120726 | | 6/2018 | |
| DE | 8501727 | | 6/1985 | |
| DE | 102011054048 | | 4/2013 | |
| DE | 102011054048 | A1 * | 4/2013 | A47L 11/26 |
| EP | 1602313 | | 12/2005 | |
| EP | 1625949 | | 2/2006 | |
| EP | 2684502 | | 1/2014 | |
| EP | 1909630 | | 7/2014 | |
| EP | 2762051 | | 8/2014 | |
| EP | 2888981 | | 7/2015 | |
| JP | S63315169 | | 12/1988 | |
| JP | H01-314545 | | 12/1989 | |
| JP | H09-135800 | | 5/1997 | |
| JP | 2000507481 | | 6/2000 | |
| JP | 2001521432 | | 11/2001 | |
| JP | 2003534086 | | 11/2003 | |
| JP | 2005138749 | | 6/2005 | |
| JP | 2005533567 | | 11/2005 | |
| JP | 2005342259 | | 12/2005 | |
| JP | 2006512951 | | 4/2006 | |
| JP | 2010201112 | | 9/2010 | |
| JP | 2010500087 | | 10/2010 | |
| JP | 2012176279 | | 9/2012 | |
| JP | 2017038926 | | 9/2019 | |
| KR | 20010027946 | | 4/2001 | |
| KR | 20120117468 | A * | 4/2001 | |
| KR | 10-2012-0042391 | | 5/2012 | |
| KR | 20010027946 | A * | 10/2012 | |
| KR | 20120117468 | | 10/2012 | |
| RU | 2008141963 | | 4/2010 | |
| TW | M538776 | U * | 4/2017 | |
| WO | WO 1998042246 | | 10/1998 | |
| WO | WO 2001182766 | | 11/2001 | |
| WO | WO 2001091623 | | 12/2001 | |
| WO | WO 2001091624 | | 12/2001 | |
| WO | WO 2006046044 | | 5/2006 | |
| WO | WO 2006121805 | | 11/2006 | |
| WO | WO 2013153426 | | 10/2013 | |
| WO | WO-2013153426 | A1 * | 10/2013 | A47L 13/146 |
| WO | WO 2015012602 | | 1/2015 | |
| WO | WO-2015012602 | A1 * | 1/2015 | A47L 11/03 |
| WO | WO 2015047891 | | 4/2015 | |
| WO | WO-2015047891 | A1 * | 4/2015 | A47L 13/16 |
| WO | WO 2018137405 | | 8/2018 | |
| WO | WO-2018137405 | A1 * | 8/2018 | A47L 11/28 |

OTHER PUBLICATIONS

Anderson and Hamilton, "The Journey Robot," Aug. 1, 2005, [retrieved on Aug. 4, 2015], Southern Methodist University, available at URL: http:/fwww_geology_smu.edu/-dpa-www/robo/jbot/, 10 pages.

Anderson, "IMU Odometry," Jul. 27, 2006, [retrieved on Aug. 4, 2015], available at URL: http://www_geology_smu_edu/dpa-www/robo/Encoder/imu_odo/, 19 pages.

Dooley et al., "U.S. Appl. No. 61/902,838, filed Nov. 12, 2013, titled Cleaning Pad," 32 pages.

Dooley et al., "U.S. Appl. No. 62/059,637, filed Oct. 3, 2014, titled Surface Cleaning Pad," 72 pages.

European Search Report issued in European Application No. 15180917.5 on Jul. 26, 2016, 4 pages.

European Search Report issued in European Application No. 15195684.4 on Jul. 27, 2016, 4 pages.

European Search Report issued in European Application No. 16200763.7 on Apr. 21, 2017, 4 pages.

International Preliminary Report on Patentability in International Appln. No. PCT/US2017/059308, dated Dec. 3, 2019, 13 pages.

International Search Report and Written Opinion in International Application No. PCT/US15/061866, mailed Feb. 2, 2015, 14 pages.

International Search Report and Written Opinion in International Application No. PCT/US2015/061277, mailed Mar. 4, 2016, 16 pages.

International Search Report and Written Opinion in International Application No. PCT/US2017/59308, dated Jan. 19, 2018, 13 pages.

International Search Report and Written Opinion issued in International Application No. PCT/US2014/062096, dated Feb. 4, 2015, 17 pages.

International Search Report and Written Opinion issued in International Application No. PCT/US2014/065004, mailed Apr. 6, 2015, 11 pages.

Invitation to Pay Additional Fees issued in International Application No. PCT/US2014/065004, mailed Jan. 23, 2015, 2 pages.

Partial European Search Report issued in European Application No. 14861203.9 on Sep. 28, 2016, 7 pages.

Schur et al., "Robotics and Artificial Lifeforms: Stasis Logic," Feb. 5, 2007, [retrieved on Aug. 4, 2015], available at URL: http://www_schursastrophotography_com/robotics/stasislogic_html, 4 pages.

* cited by examiner

CLEANING PAD FOR CLEANING ROBOT

CROSS-REFERENCE TO RELATED APPLICATIONS

This application is a continuation of and claims priority to U.S. application Ser. No. 16/827,416, filed on Mar. 23, 2020, which application is a continuation of and claims priority to U.S. application Ser. No. 15/612,234, now U.S. Pat. No. 10,595,698, filed on Jun. 2, 2017, the entire contents of each are hereby incorporated by reference.

TECHNICAL FIELD

This specification relates to cleaning pads, in particular, for cleaning robots.

BACKGROUND

An autonomous cleaning robot can navigate across a floor surface and avoid obstacles while mopping the floor surface to remove debris and stains from the floor surface. The cleaning robot can include a cleaning pad to mop the floor surface. As the cleaning robot moves across the floor surface, the cleaning pad wipes the floor surface and collects the debris.

SUMMARY

This document describes a pad for use with an autonomous cleaning robot. A forward portion of the pad is thinner than an aft portion of the pad. Varying thickness across a width of the pad provides several advantages. The pad is configured to collect debris evenly across a surface of the pad during cleaning operations. The configuration of the pad prevents debris hot spots on the pad where debris excessively accumulates relative to other portions of the pad. The configuration of the pad promotes even wetting of the pad during cleaning operations, rather than forward to aft wetting. The configuration of the pad allows more debris to collect on the pad than would collect on a pad of constant thickness. Debris can contact more portions of the pad during cleaning because some debris can pass beneath the forward portion of the pad and contact the aft portion of the pad. The pad does not push fluid and debris across a floor surface in front of the pad, and therefore, does not leave piles of accumulated debris on the floor surface after cleaning operations have completed. The pad is configured to collect debris from the floor surface and avoid leaving debris on the floor surface after cleaning operations. The pad does not adhere (e.g., suction) to the floor surface because the different thicknesses of the portions of the pad allow air to pass beneath portions of the pad during cleaning. Having less overall adhesion (e.g., suction) of the pad reduces resistances of moving the pad across the floor surface, reducing torque required by the robot to move the pad across the floor surface. The pad having lower adhesion helps reduce a need for an abrasive layer on an exterior surface of the pad, such as a layer of melt-blown plastic, etc. A soft, rather than abrasive, exterior surface of the pad can reduce scratching or scuffing of a floor surface by the pad. The lack of a need for an abrasive layer can reduce the cost of manufacturing the pad and allow more of the exterior surface of the pad to contact the floor surface.

In one aspect, the pad includes a core of absorbent layers for absorbing liquid through capillary action and for distributing the liquid within a cleaning pad. The pad includes a wrap layer around the core, the wrap layer comprising a fibrous layer that is flexible and absorbent, the fibrous layer configured to absorb liquid through capillary action and transfer the liquid to the core. The pad includes one or more transition regions spanning a cleaning width of the cleaning pad, the one or more transition regions dividing the cleaning pad into at least two segments. A forward positioned segment, of the at least two segments, has a lesser thickness compared to a thickness of an aft positioned segment of the at least two segments.

In one aspect, the forward positioned segment comprises a leading edge of the cleaning pad, and wherein the aft positioned segment has additional absorbent layers in the core, the aft positioned segment being positioned further from the leading edge of the cleaning pad than the forward positioned segment.

In one aspect, the pad includes a moisture-resistant material disposed between the wrap layer and the core in the aft positioned segment of the at least two segments, wherein the moisture-resistant material slows a rate of moisture transfer from the wrap layer to the core. The moisture-resistant material is disposed in a first amount in the aft positioned segment and a second amount in another segment of the cleaning pad, wherein the first amount is different than the second amount.

In one aspect, the forward positioned segment includes moisture-resistant material, and has less of the moisture-resistant material than the aft positioned segment. In one aspect, the moisture-resistant material comprises latex fibers.

In one aspect, the one or more transition regions comprise mechanical indentations. In another aspect, the one or more transition regions comprise an ultrasonic weld. In one aspect, the core comprises an airlaid padding.

In one aspect, the forward positioned segment extends approximately 20-30% of a length of the cleaning pad from a leading edge of the cleaning pad. The forward positioned segment extends approximately 30-40% of a length of the cleaning pad from a leading edge of the cleaning pad.

In one aspect, the pad includes a debris-adhering substance that coats an exterior of the wrap layer. The forward positioned segment is approximately half as thick as the aft positioned segment, and wherein the forward positioned segment is half a length of the aft positioned segment.

In one aspect, the pad includes a backing layer adhered to a top surface of the fibrous layer. The backing layer is configured to attach to a mobile robot. In one aspect, the backing layer includes cutouts to engage corresponding features of a pad holder on the mobile robot. The cutouts have an asymmetric pattern on the backing layer to allow the backing layer to engage with the pad holder of the mobile robot.

In one aspect, the wrap layer comprises a spun-lace material.

In one aspect, the pad includes one or more additional transition regions that are approximately orthogonal to the cleaning width of the cleaning pad.

In one aspect, the pad includes a stack of absorbent layers forming a core for absorbing liquid through capillary action and for distributing the liquid within a cleaning pad. The pad includes a wrap layer around the core that includes a fibrous layer that is flexible and absorbent. The fibrous layer is configured to absorb liquid through capillary action and transfer the liquid to the core.

In one aspect, the pad includes a moisture-resistant material disposed between the wrap layer and the core, wherein the moisture-resistant material slows a rate of moisture transfer from the wrap layer to the core. In one aspect, the pad includes one or more transition regions spanning a cleaning width of the cleaning pad, the transition regions forming five segments.

In one aspect, five segments of the pad include a first segment that forms a leading edge of the cleaning pad that includes a first amount of absorbent layers in the core. In one aspect, the five segments of the pad include a second segment adjacent to the first segment and comprising more absorbent layers in the core than the first segment. In one aspect, the five segments of the pad include a third segment adjacent to the second segment and comprising more absorbent layers in the core than the first segment and an amount of the moisture-resistant material. In one aspect, the five segments of the pad include a fourth segment adjacent to and substantially identical to the third segment. In one aspect, the five segments of the pad include a fifth segment that forms an aft edge of the cleaning pad, the fifth segment comprising more absorbent layers in the core than the first segment and less moisture-resistant material than the fourth segment.

In one aspect, this document describes a robot body including a forward portion and an aft portion. The robot includes a drive system to maneuver the robot body across a floor surface and a cleaning assembly affixed to the forward portion of the robot body, the cleaning assembly comprising a pad holder. The robot includes a cleaning pad affixed to the pad holder of the cleaning assembly.

In one aspect, the cleaning pad includes a core of absorbent layers for absorbing liquid through capillary action and for distributing the liquid within a cleaning pad. In one aspect, the cleaning pad includes a wrap layer around the core, the wrap layer comprising a fibrous layer that is flexible and absorbent, the fibrous layer configured to absorb liquid through capillary action and transfer the liquid to the core. In one aspect, the cleaning pad includes one or more transition regions spanning a cleaning width of the cleaning pad, the transition regions dividing the cleaning pad into at least two segments, wherein a forward positioned segment, of the at least two segments, has a lesser thickness compared to a thickness of an aft positioned segment of the at least two segments.

In one aspect, a forward edge of the cleaning pad is aligned with a forward edge of the robot body. In one aspect, the pad holder is configured to push the cleaning pad onto the floor surface with more pressure near a center of the cleaning pad than near edges of the cleaning pad.

The details of one or more implementations of the subject matter described in this specification are set forth in the accompanying drawings and the description below. Other potential features, aspects, and advantages will become apparent from the description, the drawings, and the claims.

BRIEF DESCRIPTION OF THE DRAWINGS

Like reference numbers and designations in the various drawings indicate like elements.

DETAILED DESCRIPTION

This document describes a cleaning pad that attaches to an autonomous cleaning robot. The pad is attached to a pad holder of the robot so that the pad contacts a floor surface as the robot navigates across the floor surface. As the robot moves the pad across the floor surface, the pad removes debris from the floor surface. The pad is shaped to trap debris underneath the pad on the pad exterior and remove the debris from the floor surface rather than push debris across the floor with a leading edge of the pad. The pad is thinner near a leading edge of the pad compared to the thickness of other portions of the pad. The pad holder of the robot is configured to push upon different portions of the pad (into the floor surface) at different pressures. For example, the pad holder can push upon a center portion of the pad with more pressure than edge portions of the pad. The pad shape and pad holder enable the pad to remove debris from the cleaning surface by allowing more of the pad surface to contact debris on the floor surface during cleaning operations of the robot relative to a pad having an approximately even thickness.

Figure 1:
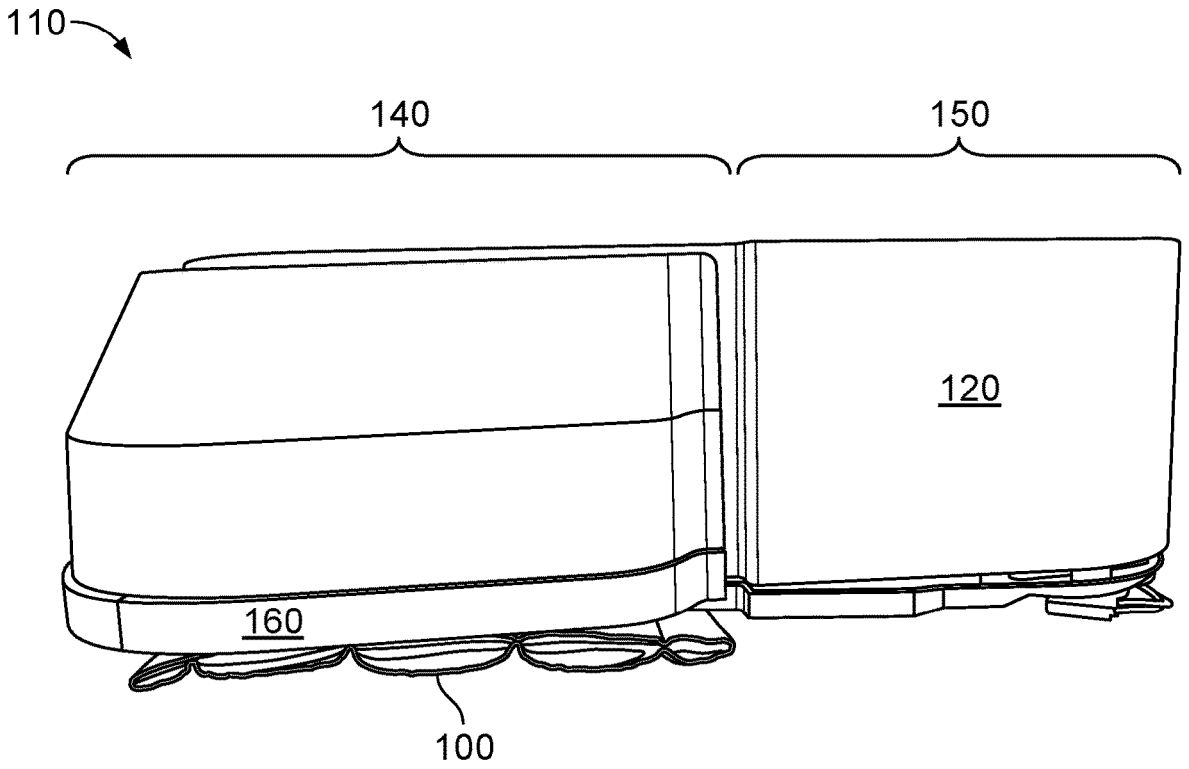
FIG. 1 is a side-view of an exemplary autonomous cleaning robot.

FIG. 1 shows a perspective view of a cleaning pad 100 attached to an autonomous cleaning robot 110. The autonomous cleaning robot 110 is configured to navigate a floor surface. The robot 110 is an autonomous mobile robot that weighs less than 10 lbs and navigates and cleans a floor surface. The robot 110 may include a body 120 supported by a drive system (not shown) that can maneuver the robot across the floor surface. In some implementations, the robot body 120 has a square shape. However, the body 120 may have other shapes, including but not limited to a circular shape, an oval shape, a tear drop shape, a rectangular shape, a combination of a square or rectangular front and a circular back, or a longitudinally asymmetrical combination of any of these shapes, etc. The robot body 120 has a forward portion 140 and a rearward portion 150. The body 120 also includes a bottom portion (not shown) and a top portion.

The bottom portion of the robot body 120 comprises one or more rear cliff sensors (not shown) in one or both of the two rear corners of the robot 110 and one or more forward cliff sensors located in one or both of the front corners of the robot. The cliff sensors can be mechanical drop sensors or light based proximity sensors, such as an IR (infrared) pair, a dual emitter-single receiver, or dual receiver-single emitter IR light-based proximity sensor aimed downward at a floor surface. The cliff sensors span between sidewalls of the robot 110 and cover the corners as closely as possible to detect flooring height changes beyond a threshold accommodated by reversible robot wheel drop prior to traversal of the respective floor portions by the robot. For example, the placement of the cliff sensors proximate the corners of the robot 110 ensures that the cliff sensors trigger when the robot 110 overhangs a flooring drop, preventing the robot wheels from advancing over the drop edge.

The robot 110 carries a pad holder (not shown) on the forward portion 140 of the robot. The pad holder extends across the front edge of the robot 110 behind a bumper 160 and is configured to hold the pad 100. The pad holder is described in further detail below in relation to FIG. 13.

The forward portion 140 of the body 120 carries a movable bumper 160 for detecting collisions in longitudinal or lateral directions. The bumper 160 has a shape complementing the robot body 120 and extends beyond the robot body 120 making the overall dimension of the forward portion 140 wider than the rearward portion 150 of the robot body. The bottom portion of the robot body 120 supports the cleaning pad 100. In embodiments, the pad 100 extends to the edges of the bumper 160 or beyond the width of the bumper 160 such that the robot 110 can position an outer edge of the pad 100 up to and along a wall surface or into a crevice. For example, the pad 100 can be maneuvered by the robot 110 to clean near a wall-floor interface by the extended edge of the pad 100 the while the robot 110 moves in a wall-following motion. Extending the pad 100 beyond the width of the bumper 160 enables the robot 110 to clean in cracks and crevices beyond the reach of the robot body 120. In some implementations, the pad 100 does not extend past the edges of the robot body 120.

The robot 110 can include a fluid applicator. The fluid applicator can have a single nozzle or multiple nozzles. The multiple nozzles are configured to spray the fluid in different directions from one another, different distances from the robot 110, or can be configured to spray in approximately the same direction. The fluid applicator applies fluid downward and outward, dripping or spraying fluid in front of the robot 110. Alternatively, the fluid applicator can be a microfiber cloth or strip.

The fluid applicator is a sprayer that includes at least two nozzles. Each of the nozzles distribute fluid evenly across the floor surface in two strips of applied fluid. The two nozzles are each configured to spray the fluid at an angle and distance different than another nozzle. The two nozzles are vertically stacked in a recess in the fluid applicator and angled from horizontal and spaced apart from one another such that one nozzle sprays relatively longer lengths of fluid forward and downward to cover an area in front of the robot 110 with a forward supply of applied fluid. The other nozzle sprays relatively shorter lengths fluid forward and downward to leave a rearward supply of applied fluid on an area in front of but closer to the robot 110 than the area of applied fluid dispensed by the top nozzle. The nozzle or nozzles dispense fluid in an area pattern that extends one robot width and at least one robot length in dimension. The top nozzle and bottom nozzle apply fluid in two distinct spaced apart strips of applied fluid that do not extend to the full width of the robot 110. The nozzles complete each spray cycle by sucking in a small volume of fluid at the opening of the nozzle so that no fluid leaks from the nozzle following each instance of spraying.

Figure 2:
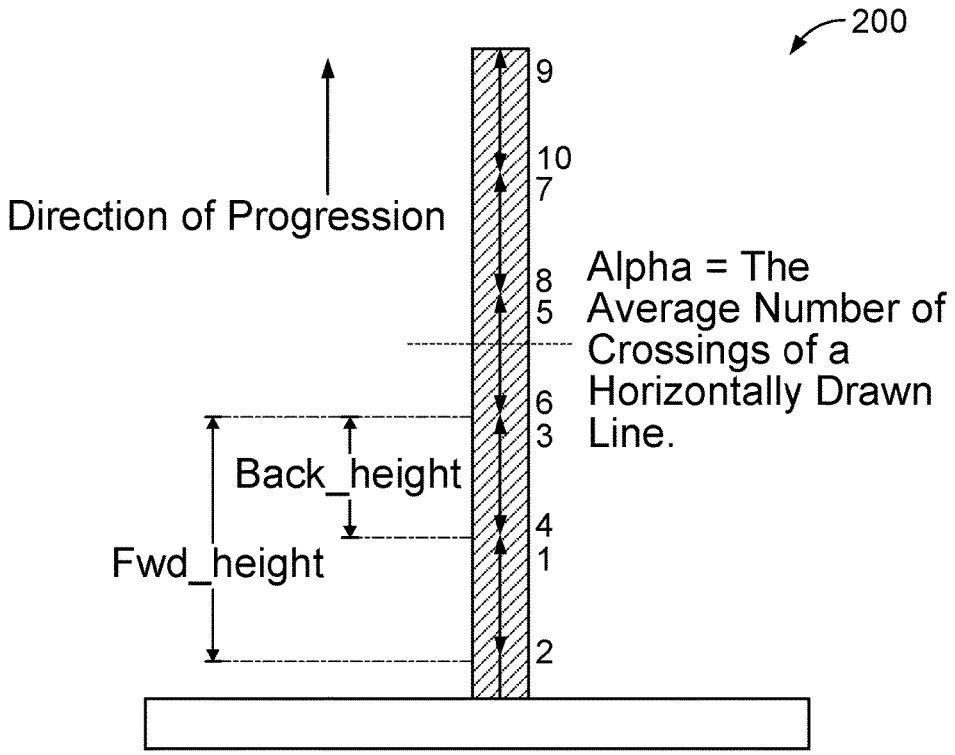
FIG. 2 is a diagram showing an exemplary path taken by an autonomous cleaning robot during cleaning operations.

FIG. 2 is a diagram of a path 200 taken by the robot (e.g., robot 110 of FIG. 1) during cleaning operations. The path 200 taken by the robot 110 details the spraying, pad wetting, and scrubbing motions of the robot. The robot 110 is configured to cover the floor surface by moving back and forth across the floor surface in approximately parallel ranks. Once the floor surface has been covered, the robot 110 can perform a perimeter cleaning maneuver to collect any debris or fluid that may have been left on the floor surface by the robot while turning between ranks.

The robot 110 cleans the floor surface using a pattern of approximately parallel ranks. For example, the robot 110 can progress in a generally forward direction during cleaning operations along a first rank. The robot 110 proceeds until a border of the floor surface is reached, such as a wall, carpet, cliff, etc. The robot 110 is configured to perform a 180 degree turn and return in a parallel but opposite direction to clean along a second rank that is offset from the first rank. The robot can turn to offset a width of the robot to clean along the second rank. Alternatively, the robot turns to offset less than a width of the robot to clean along a second rank, ensuring redundant cleaning coverage of the floor surface. The robot 110 has 60-70% overlap from a first rank to a second rank. The robot 110 cleans a portion of the floor surface 2-4 times during cleaning operations. This ensures that the floor surface has been cleaned. For example, the robot 110 loosens stains and debris with earlier passes, allowing time for any cleaning fluid that had been applied to wet the stain. The pad 100 of the robot 110 absorbs the stain and remaining debris and fluid during the later passes.

The robot 110 cleans the floor surface by progressing generally forward in straight ranks. The robot 110 performs a back-and-forth maneuver to check a portion of the floor surface before applying fluid (e.g., a cleaning solution, water, etc.) to the portion of the floor surface for cleaning operations. In embodiments, the robot 110 applies fluid to areas of the floor surface that the robot has already traversed. In other embodiments, the robot 110 does not apply fluid, such as for dry cleaning operations. The robot 110 moves in approximately parallel ranks without performing a backward and forward fluid application maneuver.

The robot performs a fluid application maneuver by moving in a forward direction along the floor surface, followed by moving in a backward or reverse direction. The robot 110 drives in a forward drive direction for a first distance to a first location, such as from location 2 to location 3 on FIG. 2. The robot 110 moves backwards a second distance to a second location, such as from location 3 to location 1, shown in FIG. 2. The nozzles spray fluid longer distances and shorter distances from the robot 110 onto the floor surface in a forward and/or downward direction in front of the robot after the robot. The robot 110 repeats the fluid application maneuver after the robot has traversed a predetermined distance since a prior fluid application maneuver was performed. The predetermined distance is approximately the length of the robot body 120.

The fluid application maneuver ensures that the robot 110 is applying fluid to a clear portion of the floor surface. The robot 110 applies the fluid to an area substantially equal to or less than the area footprint of the robot 110. The robot 110 determines that an area of floor is a clear floor surface that is unoccupied by obstacles such as furniture, walls, cliffs, carpets or other surfaces or obstacles. The robot 110 identifies boundaries, such as a flooring changes and walls, and prevents fluid damage to those items.

The robot 110 stores a map and tracks locations the pad 100 has occupied. The robot 110 stores coverage locations on the map in a non-transitory-memory of the robot or on an external storage medium accessible by the robot through wired or wireless means during a cleaning routine. Robot sensors may include a camera and/or one or more ranging lasers for building a map of a space. In some examples. the robot controller uses a map of walls, furniture, flooring changes and other obstacles to position and pose the robot 110 at distances of at least one spray length away from obstacles and/or flooring changes prior to the application of cleaning fluid. This has the advantage of applying fluid to areas of floor surface having no known obstacles thereon. In some examples. the robot 110 moves in a back and forth motion to moisten the pad 100 and/or scrub the floor surface to which fluid has been applied.

Figure 3:
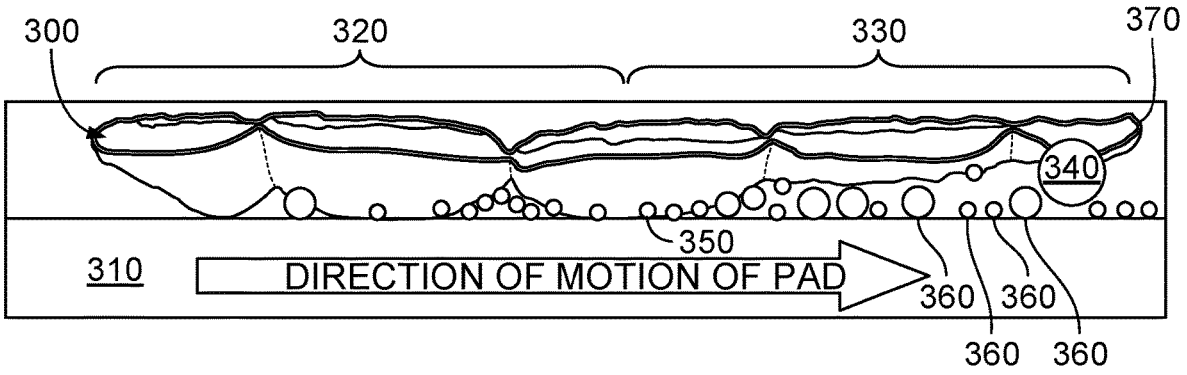
FIG. 3 is a side view of an exemplary pad showing where debris contacts the pad during cleaning operations.

FIG. 3 is a side view of a pad 300 (e.g., pad 100 of FIG. 1) showing where debris (e.g., debris 360) contacts the pad during cleaning operations. The pad 300 is thicker near an aft portion 320 of the pad than near a forward portion 330 of the pad, as described below in relation to FIGS. 5-9. The pad 300 moves across the floor surface 310 from left to right as shown in FIG. 3 when the robot 110 is moving in a forward direction. The forward portion 330 of the pad crosses the floor surface before the aft portion 320 crosses the floor surface. The pad 300 contacts the floor surface 310 of the pad than near the forward portion 330 of the pad. The forward portion 330 of the pad 300 can be suspended from the pad holder above the floor surface 310 such that a leading edge 370 of the pad does not contact the floor surface. This configuration reduces or eliminates adhesion (e.g., suction) of the pad 300 on the floor surface 310 because the molecular attraction exerted between the wet pad in contact with the wet floor surface. This is because the surface area of the pad 300 in contact with the wet floor surface is reduced to an area less than the full surface area of the pad 300 so that the robot 110 can overcome the forces of molecular attraction and push the wet pad 300 across a floor 310. For example, a small gap between portions of the pad 300 and the floor surface 310 can be maintained as the pad is suspended from the robot 110. Such a configuration can eliminate the need for an abrasive layer, such as a melt-blown plastic layer, that can otherwise be required to reduce adhesion of a pad onto the floor surface 310. For example, a pad having a constant thickness can adhere to the floor surface 310 when wetted and the molecular attraction between the pad and the floor surface requires great force to overcome and break that attraction. Adhesion can increase the force required to move the pad 300 across the floor surface 310 and cause the pad to push debris across the floor surface rather than remove the debris 360 from the floor surface. By reducing the surface area of the pad 300 contacting the wet floor surface 310, adhesion is reduced.

Additionally, the forward portion 330 of the pad 300 allows debris 360 and/or fluid to pass beneath the pad and contact the aft portion 320 of the pad. The different thicknesses of the forward portion 330 and the aft portion 320 promotes an even distribution of debris 360 on the pad 300, eliminating or reduce the occurrence of debris heavy deposit spots on the pad (e.g., relative to the rest of the pad). For example, debris buildup on the forward portion 330 of the pad is prevented. Heavy deposit spots on the pad 300 occur where there is an excessive accumulation of debris 360 on a particular portion of the pad while other portion of the pad are clean or nearly clean and collect no debris or relatively little debris. The different thicknesses of the forward portion 330 and the aft portion 320 promotes even wetting across the pad 300, such as for wet cleaning operations. Fluid is soaked up by the aft portion 320 of the pad 300 and the forward portion 330 of the pad. The pad 300 does not push debris and/or fluid along the floor surface 310 but lifts and collects the debris and/or fluid from the floor surface. Taller, less compact debris 340 is collected by the forward portion 330 of the pad 300 while more compact debris 350 is collected by the aft portion 320 of the pad.

Figure 4A:
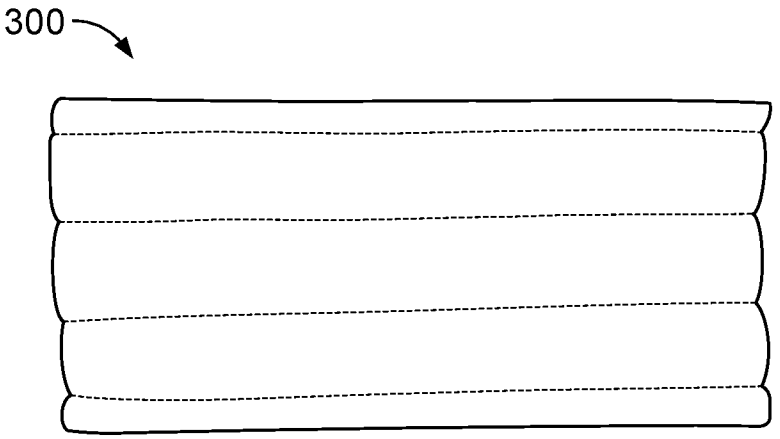
FIGS. 4A-4D are bottom views of an exemplary pad showing debris accumulation on the pad during a cleaning mission.
Figure 4B:
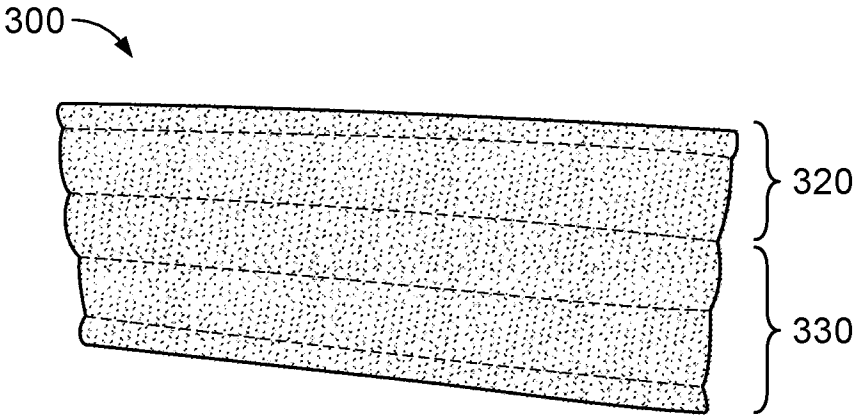
Figure 4C:
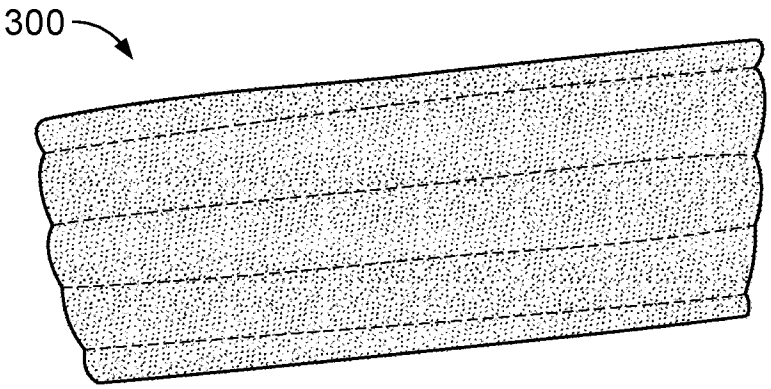
Figure 4D:
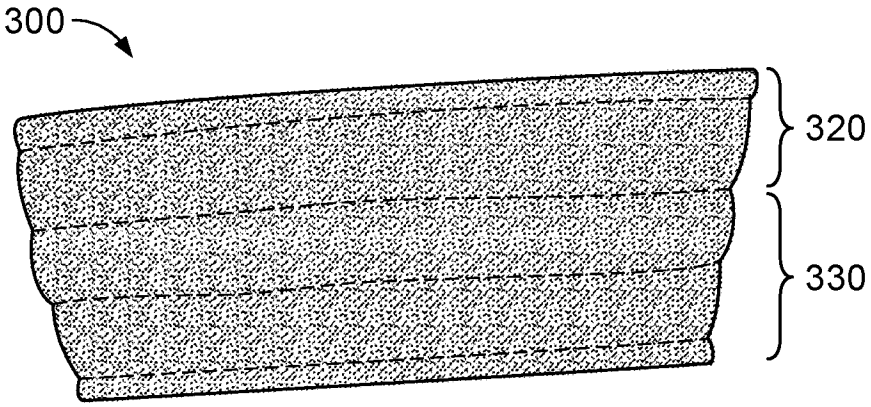

FIGS. 4A-4D are a bottom views of an embodiment of the cleaning pad (e.g., pad 300 of FIG. 3) at various cleaning stages 400, 410, 430, 440 showing debris accumulation on the pad 300 during cleaning operations. The increasing thickness of the pad from the forward portion 330 of the pad 100 to the aft portion 320 of the pad 300 promotes even wetting and debris collection by the pad 300 during cleaning operations. The varying thickness of the pad 300 can eliminate hot spots that accumulate excess debris. FIG. 4A shows an exemplary pad 300 before cleaning operations commence. The pad 300 is free of debris. FIG. 4B shows an exemplary pad 300 after light cleaning operations, or after one third of a duration of a cleaning mission. The pad 300 has debris collected across both forward 330 and aft 320 portions of the pad. FIG. 4C shows the pad 300 after moderate cleaning operations, or after two thirds of a duration of a cleaning mission. While some portions of the pad 300 have collected more debris than others, the pad 300 relatively evenly collects debris and wets evenly compared to a pad having uniform thickness. FIG. 4D shows a pad 300 after heavy cleaning operations, or at the end of a cleaning mission. Most of the pad 300 is dirty, having collected debris during cleaning operations. Both the forward 330 and aft 320 portions of pad 450 have collected significant amounts of debris. In some embodiments, the aft portion 320 collects more debris than the forward portion 330.

Figure 5:
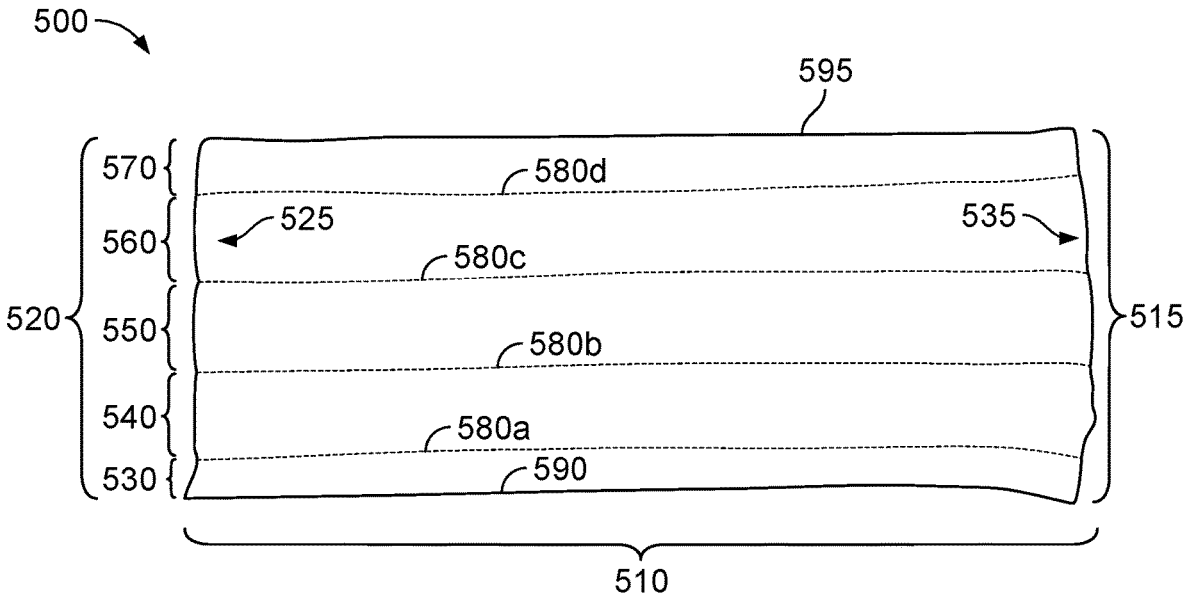
FIG. 5 is a bottom view of an exemplary pad.

FIG. 5 is a bottom view of a pad 500 (e.g., the pad 300 of FIG. 3). The pad 500 has a length 510 that spans a width of the robot (e.g., robot 110 of FIG. 1), such as across and beneath a forward edge of the robot 100. The pad 500 has a width 515 that is separated into segments 530, 540, 550, 560, and 570 (collectively referred to as "segments 520"). The segments 520 of the pad 500 are formed by transition regions 580*a-d* (collectively referred to as "transition regions 580") that extend across the length 510 of the pad. The segments 520 can be considered pockets that are separated by the transition regions 580. The pad 500 includes a leading edge 590 (which is identical to leading the edge 370 shown in FIG. 3) and a trailing edge 595. Segment 530 forms the leading edge 590 and segment 570 forms the trailing edge 595. When the pad 500 is attached to the robot, the leading edge 590 is near a front of the robot 110. The leading edge 590 contacts the floor surface 310 first when the robot 110 is moving in a forward direction during cleaning operations.

The length 510 and the width 515 are dimensioned so that the pad 500 can be affixed to a pad holder of a robot 110. Other properties of the pad 500, such as the vertical thickness, the planar width of each of the segments 530, 540, 550, 560, 570 can be scaled up or scaled down to accommodate particular cleaning operations, such as, for example, larger or smaller floor surface areas and floor surface areas with more or fewer obstacles to navigate between during a cleaning mission. In one embodiment, the pad 500 has a length 510 to width 515 ratio of approximately 5:2. The pad 500 can be different sizes. In some implementations, the pad 500 has a length 510 of approximately 27-32 cm (e.g., 27 cm, 30 cm, or 32 cm) and a width 515 of approximately 10-15 cm (e.g., 10 cm, 12 cm, 15 cm). In embodiments, the pad 500 has a length 510 of approximately 15-20 cm (e.g., 15 cm, 18 cm, or 20 cm) and a width of approximately 5-10 cm (e.g. 5 cm, 8 cm or 10 cm).

The segments 520 of the pad 500 are defined by the transition regions 580*a-d*. The segments 520 extend across the length 510 of the pad 500. The segments 520 are pockets that are formed between the transition regions 580 and that are formed on one or both edges by the transition regions 580. The transition regions 580 are formed by bonding the layers (e.g. core 610, wrap 620, moisture-resistant material 630) of the pad 500 together, thereby defining edges of pockets that form segments 520. By securing the layers, each of the segments 520 generally have a thicker center region that tapers to a thinner transition region (e.g., region 580). In one aspect, the pad 500 includes five segments 530, 540, 550, 560, 570, but other configurations of the pad are possible. In embodiments, the pad 500 includes fewer than five segments, such as two segments. For example, a first segment can be a forward-positioned segment that terminates at the leading edge 590. A second segment can be an aft-positioned segment that starts at the trailing edge 595 and terminates at the start of the forward-positioned segment. Alternatively, in embodiments, the pad may have more than five segments to increase the surface area of the pad 500 and/or to increase the number of transition regions 580 and thereby break up contact (and therefore molecular attraction) between the surface area of a wet pad 500 and a floor surface 310 more frequently. An embodiment of the pad 500 having more transition regions 580 is less likely to stick to a wet floor surface 310 during a cleaning mission because the adhesive forces of a wet pad on a wet floor are interspersed with regions of non-contact. (e.g., the regions of non-contact are the transition regions 580 dimpled inwardly from the point of maximum thickness of each pocket of each of the segments 520).

Each transition region 580 separates adjacent segments of the pad 500. The transition regions 580 are regions of the pad 500 where the layers of the pad 500 are bonded together. The transition regions 580 bond the layers of the pad 500 together from a top surface of the pad to a bottom surface of the pad. The transition regions 580 prevent bunching or sliding of material within the pad and ensure that material of one or more layers of the segments 520 retain their positions relative to the rest of the pad 500. The transition regions 580 ensure that the pad 500 retains its shape during cleaning operations; for example, that the center of the pad 500 is thicker than the forward portion of the pad 500. The transition regions 580 can assist in wicking fluid from the floor surface and transferring the fluid to a fluid retention core 610, as described in relation to FIG. 6. In some implementations, the transition regions 580 hold debris that the robot 100 has loosened and scrubbed from the floor surface 310 by wetting the floor surface and moving the pad 500 in a forward and backward scrubbing motion.

A mechanical process forms the transition regions 580. For example, mechanical embossments form the transition regions 580. The multiple layers (e.g., core 610, wrap layer 620, moisture-resistant material 630) of the pad 500 are fed though rotary embossing dies that compress the layers of the pad together, forming a strip of mechanical indentations along the transition region 580. The layers of the pad 500 are bonded together mechanically because the indentations are compressed from one or both sides through the thickness of the pad. In embodiments, the mechanical embossments are formed by a heat stamping process that fuses the layers of the pad 500 together along the transition regions 580. The layers of the pad 500 are "pinched" together to form a bond at the transition region 580. In embodiments, the transition regions 580 are formed using ultrasonic welds. For ultrasonic welds, the layers of the pad 500 are held closely together, and a high-frequency signal is applied to fuse the layers of the core 610, moisture-resistant material 630 and wrap layer 620 together though the thickness of the pad 500 (e.g., from the top surface to the bottom surface). The transition regions 580 add stiffness to the pad 500 and assist with maintaining the profile shape of the pad 500 so that the layers of the core 610 and wrap 620 do not move laterally relative to one another. Because the transition regions 580 securely affix the layers of the pad 500, this enables the moving robot 110 to impart downward force on the top surface of the pad 500 and have that fully translate to the same force applied to the bottom surface of the pad 500 in contact with the floor surface 310. The greater the movement and applied force, the greater the scrubbing action that loosens debris from the floor surface.

Additionally, the segments 520 of the pad 500 can each have dimensions that further facilitate debris collection during cleaning operations. The segments 520 each include a vertical thickness and a planar width along the forward-aft axis of the pad 500 and these thicknesses and widths vary so that the pad 500 to has a tapered configuration, as described above with regard to FIG. 3 and below with reference to FIG. 6. For example, segments 530 and 570 have a shorter width as a percentage of width 515 than segments 540, 550, and 560. Segment 530, which forms the leading edge 590, also is thinner than the other segments 540, 550, 560, 570, as described below in relation to FIG. 6. Segment 530 has a width that is 12-17% of width 515. Segment 540, 550, and 560 each have a width that is 20-25% of width 515. Segment 570 has a width that is 8-13% of width 515. This gives the pad 500 an approximately triangular profile that enables the pad 500 to wet relatively evenly across the forward and aft portions of the pad and to collect debris from the floor surface.

Figure 6:
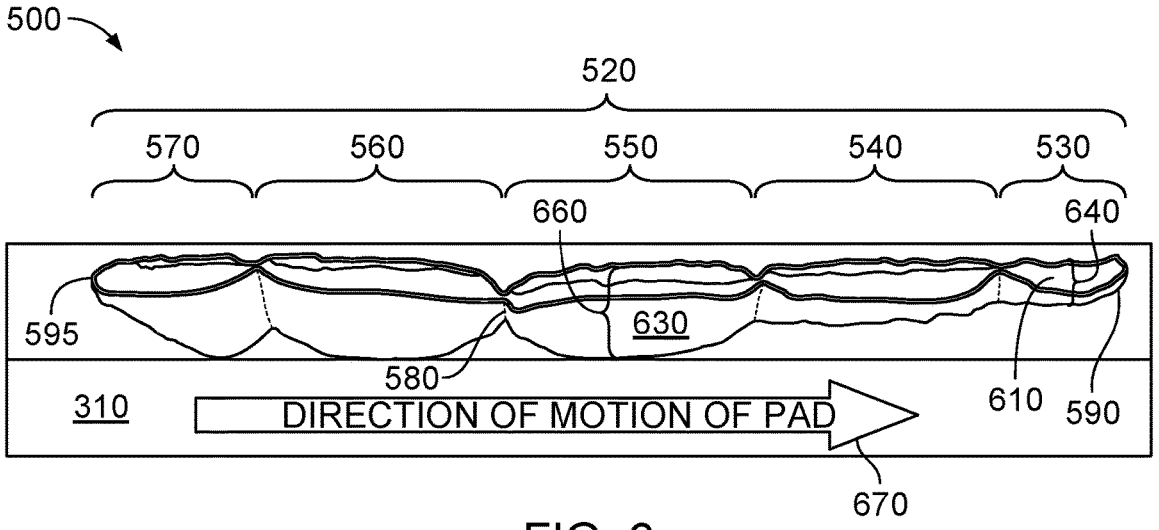
FIG. 6 is a side view of an exemplary pad.

Turning now to the FIG. 6, a side view of an embodiment of the pad 500 shows the tapered profile that allows the pad 500 to avoid motion-stopping adhesive forces and enables the pad 500 to gather and retain debris loosened from the floor surface 500. Segment 530 is a forward-positioned segment that forms the leading edge 590 and segment 570 is an aft-positioned segment that forms the trailing edge 595 as the pad 500 moves in the direction of motion labeled by arrow 670. As described above in relation to FIG. 5, segments 530, 540,550, 560, 570 are each separated by transition regions, such as transition region 580. The top of the pad 500 is relatively flat. The bottom of the pad 500 is defined by varying thicknesses (e.g., thicknesses 640, 650, 660) of the segments 520, such as having an increasing thickness for aft-positioned segments relative to forward-positioned segments. For example, the thickness 660 of segment 550 is thicker than thickness 650 of segment 540, which is thicker thickness 640 of segment 530. In some examples, thickness 640 is approximately 2-5 mm, thickness 650 is approximately 4-7 mm, and thickness 660 is approximately 8-12 mm. The thicknesses 640, 650, 660 of the pad 500 can be scaled up or down depending on size of the pad 500 and the robot 110 driving the pad 500.

Figure 7:
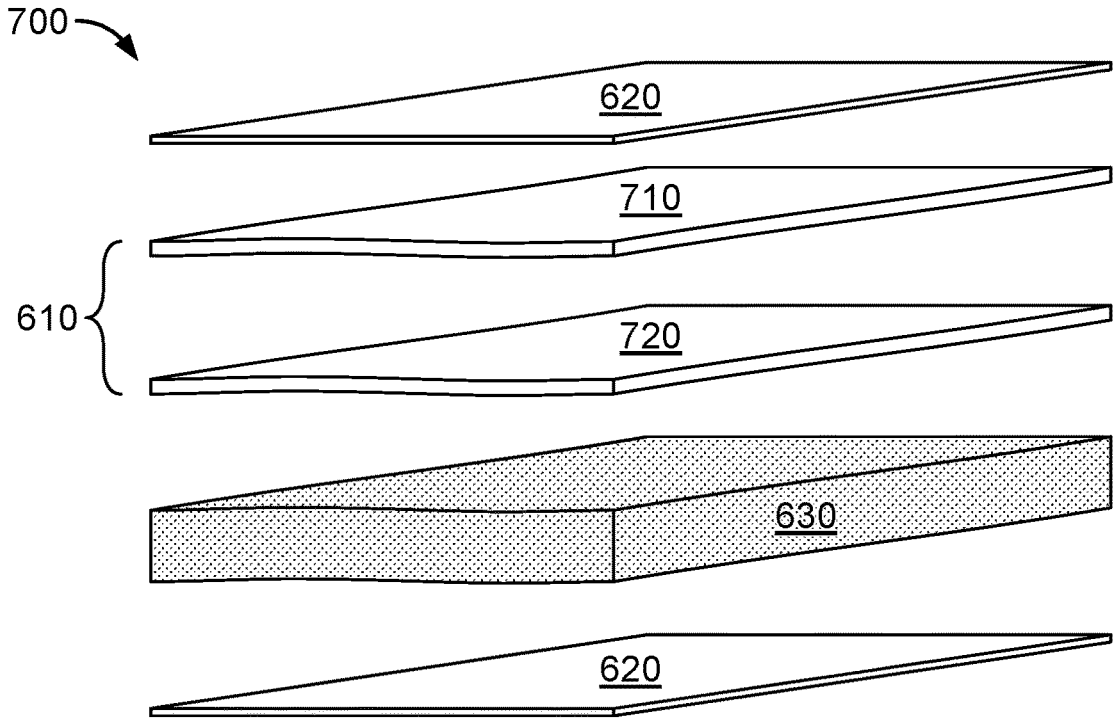
FIG. 7 is an exploded perspective view of an exemplary pad.

In embodiments, the pad 500 includes a core 610, a wrap layer 620, and a moisture-resistant material 630 that each form one or more layers of the pad 500. FIG. 7 is an exploded perspective view of the pad 500 showing each layer in relation to other layers in the stack 700.

Each segment 530, 540, 550, 560, 570 of the pad 500 includes one or more fluid absorbing layers that form the fluid retention core 610 of the pad. In some segments 520, the core 610 is formed from a stack of the fluid absorbing layers that can be bonded together. The core 610 absorbs fluid that contacts the core, such as though capillary action, and distributes the fluid throughout the core. For example, the core 610 wicks the fluid away from an exterior surface of the pad 500 and retains the fluid. Surface tension of the fluid absorbing layers prevents wicked fluid absorbed by the core 610 from leaking into lower layers of the pad 500 or onto the floor surface 310. The core 610 retains the fluid in the one or more absorbing layers such that the fluid does not leak back onto the floor surface 310, such as when the pad 500 is put under pressure against the floor surface 310 by the pad holder of the robot 110. In an embodiment, the core 610 retains approximately 90% of the fluid absorbed from the floor surface when less than 1 lb of force is applied to the core 610. The core 610 soaks up to 8-10 times the weight of the pad 500 in fluid. The core 610 can be formed from a single stack of bonded absorbent layers, or the core 610 can be formed from two or more stacks of bonded absorbent layers.

In embodiments, a bonded stack of absorbent layers comprises an airlaid material. The airlaid material includes an approximately isotropic surface. The airlaid material can be a non-linting material that is non-static. Multiple airlaid layers, each comprising a stack of absorbent layers, can be bonded together by a mechanical embossing process, such as for transition regions 580. The airlaid material includes a cellulose pulp non-woven material that is air bonded with a biocomponent fiber. The fibers of the cellulose pulp are thermally bonded with biocomponent polyethylene, polypropylene, or both, which have low melting points. The mixture forms the core 610 to be absorbent and is semi-rigid such that the core 610 retains its shape when wet. The airlaid material evenly distributes the absorbed fluid, preventing fluid accumulation or pooling in a low point of the core 610.

In embodiments, the absorbent layers of the core 610 can be heat bonded or bonded with an adhesive to form stacks of absorbent layers (e.g., core layers). Spray adhesive is applied uniformly over the absorbent layers to bond the layers together without creating ridges or rigid areas of the core 610. The adhesive includes polyolefin. The adhesive enables fluid to wick between the absorbent layers of the core 610, promoting a substantially even distribution of fluid within the core. A latex bonding agent can be applied to the absorbent layers of the core 610 to reduce linting of the absorbent layers and to minimize sloughing of the absorbent layers from the core.

In embodiments, the core 610 can be of non-uniform density, such as to promote wicking of fluid away from a surface of the core and toward an interior of the core. The surface of the core 610 can be slightly denser than the interior of the core. The denser surface of the core 610 is smoother and slightly less absorptive than the interior of the core. The core 610 is configured to retain and distribute fluid throughout the center of the core.

The core 610 forms a base for the pad 500. The core 610 is semi-rigid to retain the shape of the pad 500. The transition regions 580 stiffen the core 610 and add help the core retain structure. The segments 520 of the pad 500 each include one or more layers of the core 610. Segments of the pad 500 have different numbers of layers of core 610 material. For example, segment 530 includes a single layer of core 610, while segments 540, 550, 560, and 570 each include two or more layers of core 610. In some implementations, a single core 610 layer includes airlaid. In some implementations, a single core 610 layer includes latex.

In embodiments, the wrap layer 620 wraps around the one or more layers of the core 610 and forms an outer surface of the pad 500. The wrap layer 620 includes a flexible and absorbent material that covers the core 610 and prevents the core from being directly exposed to the floor surface 310. In embodiments, the wrap layer 620 includes a fiber-entangled material. The wrap layer 620 contacts the floor surface during cleaning operations. The wrap layer 620 absorbs fluid from the floor surface by capillary action during cleaning operations. The wrap layer 620 transfers the fluid into the core 610, where the fluid is retained by the pad 500.

The wrap layer 620 can be formed from a material that is flexible, absorbent, and thin, such as a spun-lace material, a spun-bond material, and so forth. In some implementations, the wrap layer 620 is formed by a fiber-entangling process, such as hydroentangling, water entangling, jet entangling, hydraulic needling, etc. being applied to a precursor web. The precursor web is formed from staple textile-like fibers. The precursor web can be a single fiber webs or made of many different fiber blends. The fibers can include can include one or more of polyester, viscose, polypropylene, cotton, and other similar materials.

The wrap layer 620 is configured for wet, damp, or dry cleaning operations, such as to mop a floor surface or to dust a floor surface The wrap layer 620 can include an external coating of one or more cleaning materials, debris removing materials, etc. The wrap layer 620 includes a cleaning agent surfactant such as butoxypropanal, alkyl polyglycoside, dialkyl dimethyl ammonium chloride, polyoxyethylene castor oil, alkylbenzene sulfonate, glycolic acid, or other surfactant.

In some implementations, the wrap layer 620 can include an external coating of an antistatic agent such as those based on long-chain aliphatic amines (optionally ethoxylated) and amides, quaternary ammonium salts (e.g., behentrimonium chloride or cocamidopropyl betaine), esters of phosphoric acid, polyethylene glycol esters, or polyols. Other aspects of a pad 900 configured for dry cleaning are described below in relation to FIGS. 9-10.

Returning to FIGS. 6 and 7, the pad 500 includes the moisture-resistant material 630. The moisture-resistant material 630 forms a moisture-resistant layer and can be disposed between portion of the wrap layer 620 and the core 610. The moisture-resistant material 630 retards (e.g., slows a rate of) fluid transfer between the wrap layer 620 and the core 610. The rate of fluid transfer is controlled by the moisture-resistant material 630 to control a rate of fluid absorption in the core 610. The moisture-resistant material 630 improves cleaning of the pad 500 because the pad 500 does not immediately become soaked with fluid while cleaning but leaves some fluid on the floor surface. For example, the wrap layer 620 wets before fluid is significantly absorbed in the core 610, allowing the pad 500 to mop the floor surface 310. The moisture-resistant material 630 is disposed between the core 610 and the wrap layer 620 so that fluid that is carried by the core 610 is not easily transferred back to the wrap layer 620 but rather wicked into the interior of the core 610. The moisture-resistant material prevents the wrap layer 620 from becoming saturated and adhered to the core 610 by moisture, which can cause adhesion of the pad 500 on the floor surface 310. Adhesion of the pad 500 on the floor surface 310 can prevent the pad from allowing debris and fluid to accumulate under the pad and prevent the robot 110 from moving across the floor surface 310.

In embodiments, the moisture-resistant material 630 includes a batting material. The batting material includes loosely entangled fibers of low density relative to the core 610. The moisture-resistant material 630 wicks fluid from the wrap layer 620 and transfers the fluid to the core 610 at a first rate that is slower than a second rate of fluid transfer that occurs when the wrap layer directly contacts the core. As stated above, slowing the rate of fluid transfer enables the pad 500 to leave some fluid on the floor surface 310 during cleaning operations, which enables the fluid to soak stains or other debris on the floor surface for later absorption into the pad 500 during another pass by the mobile robot. In embodiments, the mobile robot 110 traverses the floor surface 310 in overlapping parallel ranks terminating at 180 degree turns. In embodiments, the robot 110 overlaps with a previously traversed rank by approximately two thirds the width of the body of the robot 110 or two thirds the width of the pad 500 attached to the robot 100, so that every spot on a floor surface is contacted three times by the pad 500. During these passes, the fluid applied to the floor surface by the robot is wicked away from the moisture-resistant material 630 by the core 610. The low density of the moisture-resistant material 630 prevents the moisture-resistant material 630 from storing excess fluid such and transferring fluid back to the wrap layer 620 from the core 610. Such a configuration allows the wrap layer 620 to be dryer to absorb more fluid from the floor surface 310 and improves wicking of fluid and suspended debris into the core 610. In embodiments, the moisture-resistant material 630 can include latex fibers. In embodiments, the moisture-resistant material 630 can include a cotton batting.

The moisture-resistant material 630 is disposed in varying amounts (e.g., different volumes, but equal density) in the segments 520. The moisture-resistant material 630 gives volume to one or more of the segments 520. The tapered cross-sectional shape of the pad 500 is formed by varying the amount of the moisture-resistant material 630 in each of the segments 520 so that the aft portion of the pad is thicker than the forward portion of the pad. In embodiments, the density of the moisture-resistant material 630 is approximately equivalent throughout the segments 520 of the pad 500 so that the rate of fluid absorption into the core 610 is varied only by the volume of moisture resistant material in each of the segments 520. In the embodiment of FIGS. 3, 5 and 6, segments 530 and 540 include no moisture-resistant material 630, and segments 550, 560, and 570 include moisture-resistant material 630. The amounts of moisture-resistant material 630 in each segment controls how the pad 500 contacts the floor surface 310, such as to promote even distribution of debris collection on the bottom of the pad 500, as described above in relation to FIG. 3.

The moisture-resistant material 630 is disposed on a surface of the core 610 that faces the floor surface 310 during cleaning operation. The top surface of the pad 500, which includes a pad backing (described in greater detail in relation to FIGS. 12-13, below), includes the wrap layer 620 in contact with the core 610. Moisture-resistant material 630 is not needed to reduce fluid transfer between the core 610 and the wrap layer 620 because the top surface of the pad 500 does not contact the floor surface 310.

Returning to FIGS. 5 and 6, the pad 500 has bluntly cut ends 525, 535 such that the core 610 is exposed at both ends of the pad 500. Because the wrap layer 620 is unsealed at the ends of the pad 500, the ends of the core 610 are uncompressed and available to absorb fluid. The full length 510 of the pad 500 is available for fluid absorption and cleaning. No portion of the core 610 is compressed by the wrap layer 620 and therefore unable to absorb fluid. Because the wrap layer 620 is unsealed at the ends of the pad 525, 535, the core 610 is uncompressed at the ends of the pad 525, 535 and the ends 525, 535, therefore, are able to absorb as much fluid as other portions of the core 610 of the pad 500 inbound form the ends 525, 535. Additionally, because the wrap layer 620 is unsealed at the ends 525, 535 of the pad 525, 535, a used pad 500 does not have soaking wet floppy ends of wrap layer 620 extending from the ends 525, 535 of the pad 500 at the completion of cleaning operations. Rather, fluid is absorbed and held by the core 610, reducing or preventing drips.

The thicknesses of the segments 520 promote even distribution of debris collection on the pad 500. In some implementations, the pad 500 is generally thicker near the aft portion 320 of the pad than near the forward portion 330 of the pad 500 relative to the direction of motion of the pad 670 across a floor surface 310 during cleaning operations. A forward-positioned segment, such as segment 530, is thinner than an aft-positioned segment, such as segments 540, 550, 560, and 570. For example, segment 530 includes the core 610 surrounded by the wrap layer 620, and has a first thickness 640. Segment 540 includes the core 610 at double thickness relative to segment 530, such as including two stacks of bonded absorbent material layers 710, 720. Segment 540 has a second thickness 650 that is greater than the first thickness 640. The first thickness is approximately 5-10 mm. The second thickness is approximately 7-13 mm. Segment 530 includes a first thickness of the core 610, and the other segments 540, 550, 560, and 570 each include a second thickness of the core 610 that is approximately twice as thick as the first thickness 640.

In embodiments, the pad 500 can include more than two segments. Segment 550 is aft of segments 530 and 540 and includes the moisture-resistant material 630 between the wrap layer 620 and the core 610. Segment 550 has a third thickness 660 that is greater than the second thickness 650 and the first thickness 640. Segments 550, 560, and 570 each have the third thickness 630. The third thickness 630 is approximately 15-25 mm. Segments 550, 560, and 570 respectively increase in thickness. Segments 550, 560, and 570 each include the moisture-resistant material 630 that is disposed between the core 610 and the wrap layer 620.

The transition regions 580 divide the width 515 of the pad 500 into the segments, as described above in relation to FIG. 5. The transition regions 580 are regions of the width 515 wherein the core 610, the wrap layer 620, and the moisture-resistant material 630 (if applicable) are bonded to form indentations in the pad 500. The transition regions 580 can have a thickness that is less than the thickness 640 of the pockets of the segments 520. The transitions regions 580 help prevent the pad 500 from adhering to the floor surface by creating intermittent positions across the surface area of the pad 500 at which the pad 500 does not contact the floor surface 310 during cleaning operations. Because they disrupt pad 500 contact with the floor surface 310, the intermittent transition regions 580 prevent a wet pad 500 from adhering to a floor surface 310 and reduce the amount of force required by the robot 110 to push a wet pad 500 across the floor surface 310. Additionally, the transition regions 580 facilitate wicking between the core 610, wrap layer 620, and moisture-resistant material 630 (if present). The wicking action provided by the transition regions 580 facilitates even fluid absorption by the core 610 across the width 515 of the pad 500. For example, the pad 500 does not wet from forward to aft but more evenly from the bottom surface of the pad 500 in contact with the floor surface to the top of the pad 500 that is fastened to the pad holder of the robot 110.

Figure 8:
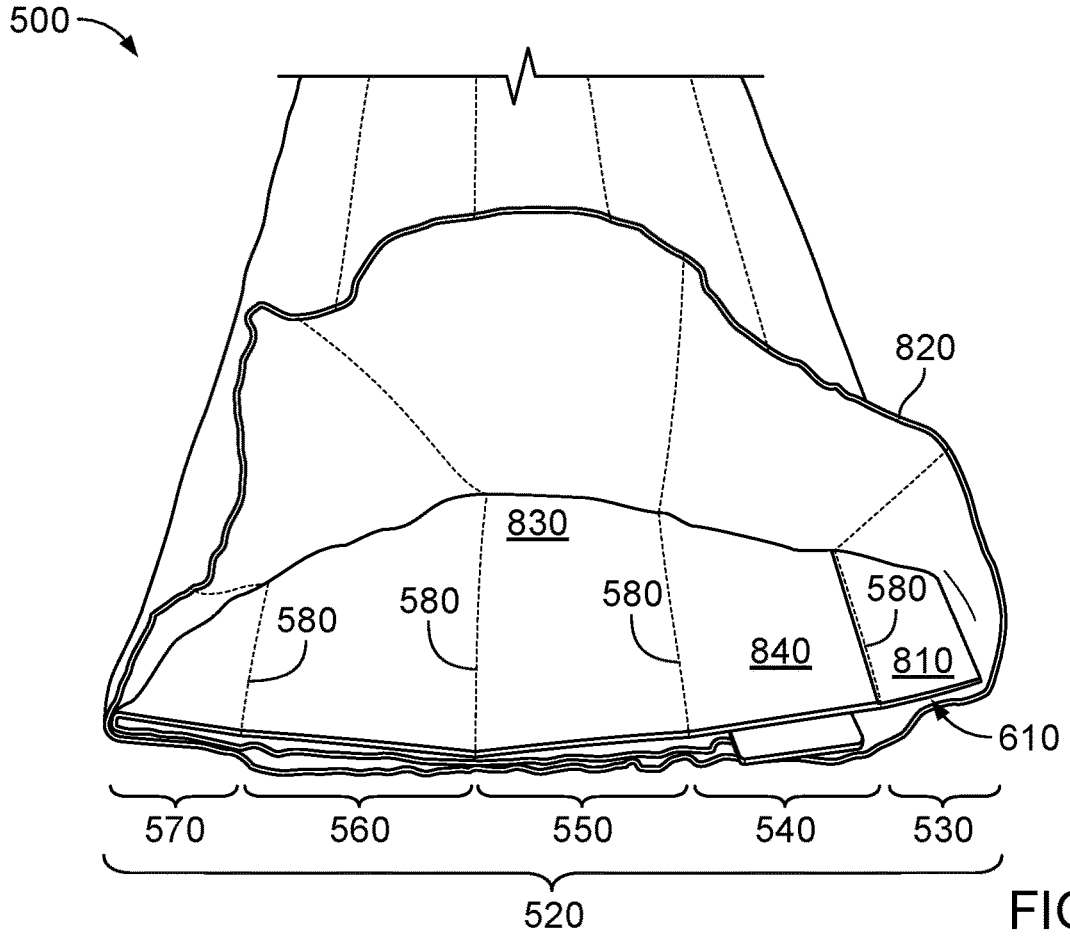
FIG. 8 is a perspective cut-away view of an exemplary pad showing layers of the pad.

Turning now to the types of applications of cleaning, FIG. 8 is a perspective cut-away view of an embodiment of the pad 500 used for wet cleaning operations, such as to remove fluids from the floor surface 310. As discussed above in relation to FIG. 6, a first layer 810 of the core 610 of the pad 500 extends across the width 515 of the pad though each of the segments 530, 540, 550, 560, 570 and transition regions 580. A second layer 840 of the core 610 of the pad 500 extends across segments 540, 550, 560, and 570. The core 610 is thinner in the forward-positioned segment 530 than the aft-positioned segments 540, 550, 560, 570. The wrap layer 820 extends beneath the entire core 610 for all the segments 530, 540, 550, 560, 570 and wraps above the core 610 to surround the core 610. The moisture-resistant material 630 is packed into segments 550, 560, and 570.

The moisture-resistant layer 830 gives the pad 500 volume (e.g., vertical thickness) in the aft-positioned segments 550, 560, 570 and reduces or eliminates contact area between the forward-positioned segments 530, 540 on the floor surface relative to the contact area between the floor surface and segments 550, 560, 570. The moisture-resistant layer 830 causes segments 530, 540 to be suspended just above the floor surface during cleaning operation, as the pad 500 and the robot 100 rest on segments 550, 560, 570. The moisture-resistant layer 830 is thicker in segment 570 than segment 560 and thicker in segment 560 than segment 550. The wrap layer 820 surrounds the moisture-resistant layer 830, the first core layer 810, and the second core layer 840. The transition regions 580 bond the first core layer 810, the second core layer 840, the wrap layer 820, and the moisture-resistant layer 830 (where applicable) together. Each segment 530, 540, 550, 560, 570 defines a pocket with the wrap layer 820 surrounding the first core layer 810, and the second core layer 840. For segments 550, 560, and 570, the wrap layer 820 forms the pocket around the moisture-resistant layer 830.

Under the weight of the robot 110, a pad holder (e.g., pad holder 1300 of FIG. 13, described below) applies a greater pressure to the center of the pad 500 rather than edges 1295*a*, 1295*b* of the pad 500 because the pad 500 extends beyond the length of the pad holder 1300. Applying differential pressure to the center and edges of the pad 500 promotes even wetting and debris accumulation on the pad 500 by allowing debris and fluid to pass beneath the pad for absorption and retention by the center portion of the pad. For example, when the robot 110 is turning, debris can pass sideways across a length of the pad 500 to the center of the pad 500 where it is collected and retained, rather than being pushed by the side or forward edge of the pad 500 and being left on the floor surface 310 or accumulating only on edges of the pad. In embodiments, the center of the pad 500 is the 60-90 percent of the surface area of the pad 500 inbound of the lateral edges the lateral edges 1295*a*, 1295*b* and in contact with the floor surface 310. In embodiments, the center of the pad 500 is located along a longitudinal axis 1280 spanning between the lateral (e.g., left and right) edges 1295*a*, 1295*b* of the pad 500 and bisecting the pad 500. In embodiments, the pad holder 1300 of the robot 110 applies an even pressure on the aft portion 320 of the pad 500 spanning the length of the pad holder 1300 and contacting the floor surface 310. The pad holder 1300 is described in greater detail, below.

In this embodiment, due to the varying thicknesses of the segments 530, 540, 550, 560, and 570, segments 530 and 540 either do not contact the floor surface at all or with as much pressure as the aft-positioned segments 550, 560, 570. For example, the core 610 is thinner in segment 530 than in segments 540,550, 560, and 570. Segment 530 lightly contacts or suspends above the floor surface 310 and allows some debris and fluid to pass beneath the segment 530 underneath the pad 500, allowing the aft-positioned segments 540, 550, 560, 570 to wet evenly and remove debris from the floor surface as described above. Additionally, segment 540 does not include the moisture-resistant layer 830 and is thinner than the segments 550, 560, 570 that do include the moisture-resistant layer. Segment 540 allows some debris and fluid to pass beneath the segment 540, allowing segments 550, 560, and 570 to remove the debris and fluid from the floor surface. Pad 500 is configured to wet evenly and collect debris evenly across each of the segments 530, 540, 550, 560, 570 during cleaning operations.

Figure 9:
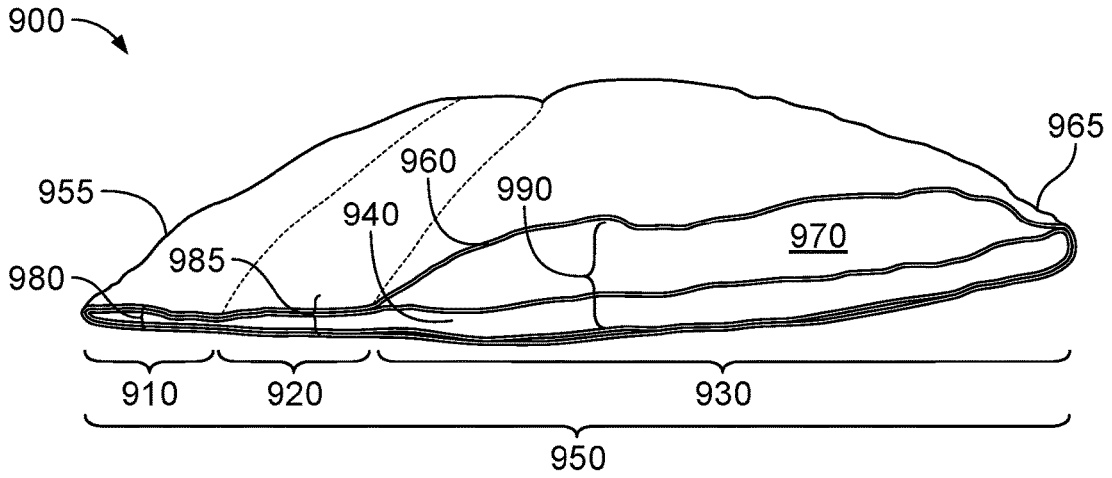
FIG. 9 is a side view of an exemplary pad.

In other embodiments, a pad 900 is configured for dry cleaning operations. FIG. 9 is a side view of the pad 900. For example, pad 900 is suitable for dusting a floor surface. Pad 900 includes a forward segment 910, a middle segment 920, and an aft segment 930. Forward segment 910 is configured to form a leading edge 955 of the pad 900. Aft segment 930 is configured to form a trailing edge 965 of the pad 900. Middle segment 920 connects the forward segment 910 and the aft segment 930. Similar to pad 500, the pad 900 includes an approximately triangular profile.

A core 940 extends across the width 950 of the pad 900. The core 940 can include bonded absorbent layers that form a semi-rigid base for the pad 900. The core 940 can be similar to the core 610 of pad 500. For example, core 940 can include one or more airlaid layers. Core 940 can be a different material that is less absorbent than core 610 or not absorbent at all.

A wrap layer 960 wraps around one or more layers of the core 940 and forms the outer surface of the pad 900. The wrap layer 960 can be the same or similar to the wrap layer 620, such as described above in relation to FIG. 6. The wrap layer 960 can be different than wrap layer 620, such as including non-absorbent or semi-absorbent materials. In embodiments, the wrap layer 920 includes a static coating that promotes the collection of debris on the wrap layer from the floor surface, such as described above in relation to FIG. 6. The wrap layer 960 is adhered to the core 940 using an adhesive, such as a glue. There are no transition regions for pad 900, such as the transition regions 580 of pad 500. Rather, the segments 910, 920, 930 can be defined based on the amount of the core 940 and volume layer 970 materials present in each respective segment 910, 920, 930. Because the molecular force of wet attraction (e.g., adhesion) is not an issue in a dry pad embodiment, the layers of the pad 900 are less likely to stick and prevent robot movement 110 and/or the application of force form the top of the pad 900 to the bottom of the pad 900.

In embodiments, the pad 900 includes a volume layer 970. The volume layer 970 is a low-density batting. The volume layer can include the moisture-resistant material 630, such as the latex batting described above in relation to FIG. 6. The volume layer 970 increases the thickness of the pad 900 in the aft segment 930, relative to thicknesses of the forward segment 910 and the middle segment 920. The volume layer 970 creates a soft, pillow-like surface in the aft segment 930 that contacts the floor surface with greater pressure than the surfaces of the forward segment 910 and the middle segment 920. The forward segment 910 can be suspended above the floor surface, similar to segment 530 of pad 500 described above.

Each segment of the pad 900 includes varying amounts of material, varying the thicknesses of the pad from the forward portion to the aft portion of the pad 900. The forward segment 910 includes the core 940 that is surrounded by the wrap layer 960. The middle segment 920 includes the core layer 910 having an increased thickness relative to the core layer of the forward segment 910, surrounded by wrap layer 960. The aft segment 930 includes the core layer 910 having greater thickness than the core layer of the forward segment 910, the volume layer 970, and the wrap layer 960.

The pad 900 includes an increasing thickness from a forward portion of the pad to an aft portion of the pad 900. Forward segment 910 has a first thickness 980 that is thinner than a second thickness 985 of middle segment 920. The second thickness 985 of the middle segment 920 is thinner than a third thickness 990 of the aft segment 930. In embodiments, the first thickness 980 of the forward segment 910 is 40-60% as thick as the second thickness 985 of the middle segment 920. In embodiments, the second thickness 985 of the middle segment 920 is 20-30% as thick as the third thickness 990 of the aft segment 930. The forward segment 910 and the middle segment 920 contact the floor surface during cleaning operations with less pressure than the aft segment 930, allowing debris to reach the aft segment without pushing the debris across the floor surface beneath the robot 110. The forward segment 910 and the middle segment 920 allow some debris to pass beneath portions of the pad 900 during cleaning operations, promoting even collection of debris by each of the forward segment 910, middle segment 920, and the aft segment 930.

Figure 10:
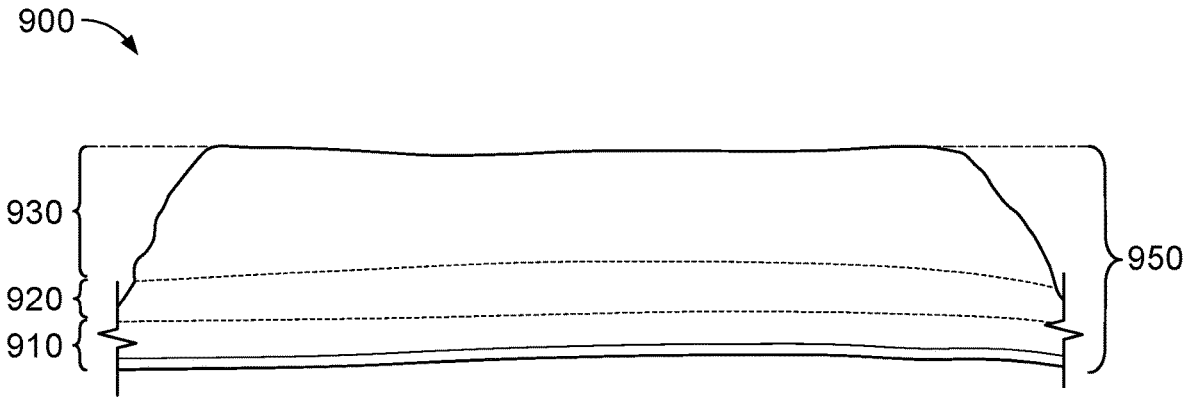
FIG. 10 is a perspective view of an exemplary pad.

FIG. 10 is a perspective bottom view of the pad 900. The pad 900 increases in segment widths from forward segment 910 to aft segment 930 in the direction of the pad width 950. In embodiments, the forward segment 910, middle segment 920, and aft segment 930 can each have different widths as measured along the forward-aft direction of the pad 500 corresponding to the forward-aft motion of the robot 110 during travel. In embodiments, the combined width of forward segment 910 and middle segment 920 together is approximately 30%-40% (e.g., 30%, 32%, 34%, 36%, 38% or 40%) of width 950, and, in embodiments, the aft segment 930 is approximately 60%-70% (e.g., 60%, 62%, 64%, 66%, 68%, or 70%) of width 950. As stated above, in embodiments, the pad 900 does not include indentations that form transition regions 580 of pad 500, and no wicking of fluid from the wrap layer 960 to the core 940 is needed.

Figure 11:
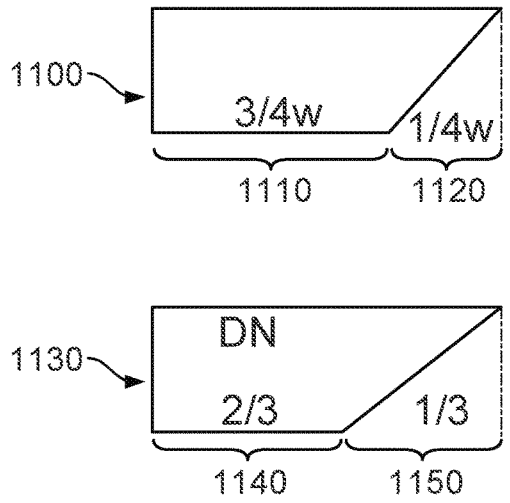
FIG. 11 is a diagram showing exemplary pad thicknesses.

FIG. 11 is a diagram showing example end views of wet and dry pads according to embodiments of the invention. Pad 1100 represents a wet pad (e.g., pad 500 of FIGS. 5-6). Pad 1130 represents a dry pad (e.g., pad 900 of FIGS. 9-10). Each pad 1100, 1130 includes a forward "tapered" portion and an aft "non-tapered" portion. The forward portions of pads 1100, 1130 contact the floor surface with less pressure than the aft portion of the pads 1100, 1130 during cleaning operations. For example, the forward portion 1120 of the wet pad 1100 allows some fluid and debris to contact the aft portion 1110 of the pad 1100 from the floor surface. The difference in thicknesses between the forward portion 1120 and the aft portion 1110 promotes even wetting and debris distribution across the length of the wet pad 1100, as described above. For the wet pad 1100, the ratio of the forward portion 1120 width to the aft portion 1110 width is approximately 1:4, such that the forward portion 1120 is approximately 20-30% (e.g., 20%, 22%, 25%, 26% 28%, or 30%) of the width of the wet pad 1110 and the aft portion is approximately 70-80% (e.g. 70%, 72%, 74%, 75%, 76%, 78%, or 80%) of the width of the pad. The width of each pad is the dimension spanning between the forward, or leading, edge of the pad and the aft, or trailing, edge of the pad.

Similarly, the dry pad 1130 includes a forward portion 1150 that is thinner than the aft portion 1140. For example, the forward portion 1150 of the dry pad 1130 allows some debris to contact the aft portion 1140 of the pad from the floor surface. The difference in thicknesses between the forward portion 1150 and the aft portion 1140 promotes even debris distribution across the length of the pad 1100, as described above. The difference in thicknesses between the forward portion 1150 and the aft portion 1140 prevents the accumulation of debris on the dry pad 1130 in particular, small regions called "debris hot spots" that collect debris while other portions of the pad 1130 remain clean. For example, in embodiments, the ratio of the forward portion 1150 width to the aft portion 1140 width of the dry pad 1130 is approximately 1:3, such that the forward portion 1150 is approximately 25-35% of the width of the dry pad 1130 and the aft portion is approximately 65-75% of the width of the pad.

The ratios of the forward portions 1110, 1140 to the aft portions 1120, 1150, respectively, are different for the wet pad 1100 and the dry pad 1130. Dry debris is more voluminous and less adhesive than wet debris. Dry debris covers a greater portion of the dry pad 1130 during cleaning operations, relative to the portion of the wet pad 1100 that is covered by the wet debris. The dry pad 1130 includes a larger ratio of the forward portion width to the aft portion width relative to the wet pad 1100. The dry pad 1130 allows larger debris room to pass beneath the forward portion 1150 of the dry pad and collect and compact the larger debris so that some portions of debris are sufficiently compact to be entrapped by and beneath the aft portion 1140 riding on the floor surface 310. Because dry debris is more voluminous and less compactable than wet debris, the dry pad 1130 has a larger overhanging leading edge than the wet pad 1100. By having a larger forward portion 1150, the dry pad 1130 rides up on fluffy dry debris and collects the voluminous dust and debris under the forward portion 1150 rather than pushing larger pieces of debris around in front of the robot 110.

Figure 12:
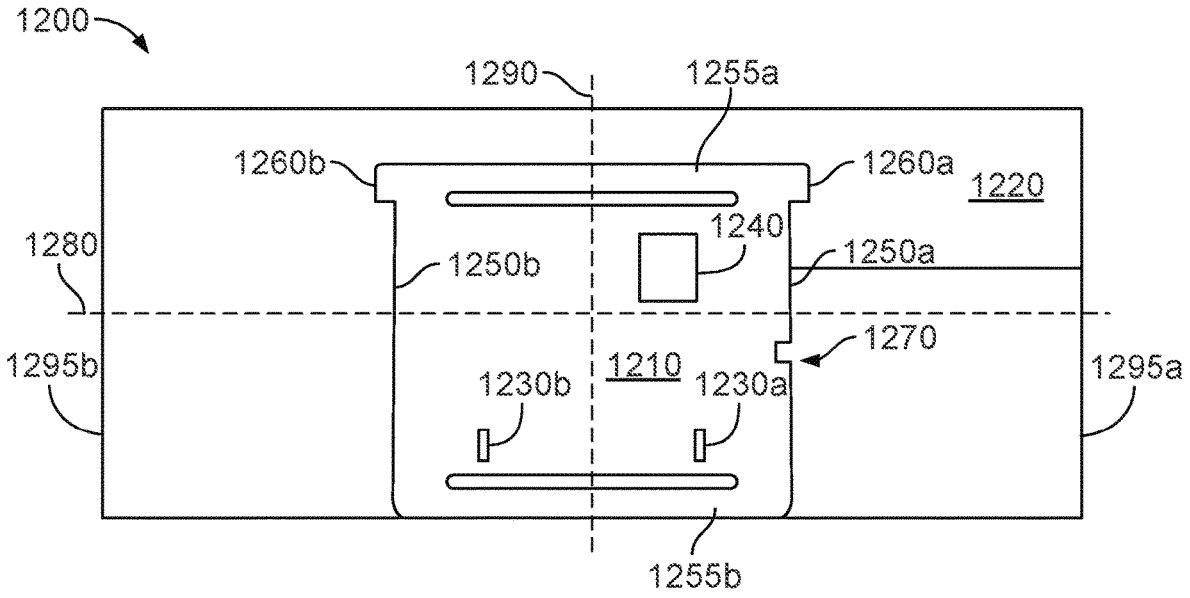
FIG. 12 is a top view of an exemplary pad showing a backing layer of the pad.

Turning now to assembly of a pad 300, 500, 900 to a robot 1100, as shown in the embodiment of FIG. 12, a backing layer 1210 can be affixed to the pad and that backing 1210 layer serves as an interface between the pad and the robot 110. FIG. 12 is a top view of a pad 1200 showing a backing layer 1210 of the pad. The pad 1200 can include any of the pads described above. The backing layer 1210 includes a rigid or semi-rigid layer that is affixed to the pad body 1120. The pad 1200 is attached to a robot 110 using the backing layer 1210 as a mount. The backing layer 1210 includes one or more apertures for engaging with protrusions on the pad holder 1300 of the robot 110, such as apertures 1230*a* and 1230*b*. The backing layer 1210 attaches to a pad holder of the robot 110, such as described below in FIG. 13. In embodiments, the backing layer 1210 is a cardboard material. In other embodiments, the backing layer is plastic and the pad is a reusable and/or washable material.

In some implementations, the backing layer 1210 does not protrude beyond the edges 1295*a*, 1295*b* of the pad 1200. (Edges 1295*a*, 1295*b* correspond to edges 525, 535 in the embodiment of the pad 500 of FIG. 5). In embodiments, the pad holder 1300 of the robot 110 retains the backing layer 1210 by clamping the edges 1250*a*, 1250*b* of the backing layer 1210. In some implementations, longitudinal edges 1255*a*, 1255*b* protrude from edges of the pad 1200. In some implementations, the longitudinal edges do not protrude from the edges of the pad 1200. In embodiments, the backing layer 1210 is shaped to engage with the pad holder 1300 in a single orientation and to signify a pad type (e.g., wet, dry, etc.). For example, a shape of the backing layer 1210 can communicate to the robot 110 what kind of pad (e.g., dry pad 1130 or wet pad 1100) is attached to the robot. For example, the shape of the backing layer 1210 can be asymmetrical about the longitudinal axis of the pad such that the pad 1200 is fitted into the pad holder in a single orientation. In embodiments, a printed arrow or other symbol indicates a preferred or required orientation of the pad 1200 in the pad holder of the robot 110.

In embodiments, the backing layer 1210 includes keyed apertures 1230*a*, 1230*b* that receive protrusions 1320*a*, 1320*b* of the pad holder 1300 of the robot 110 for holding the pad 1200 on the robot 110. In some embodiments, the apertures 1230*a*, 1230*b* are located at symmetrical distances from edges 1295*a*, 1295*b* such that the pad 1200 can be affixed to the pad holder in more than one orientation. An aperture 1240 provides an opening for a sensor on the robot 110 to detect pad type indicia on the top surface of the pad 1200 and relay signal indicative of a type of the pad 1200 to the robot 110. For example, the type of pad can include the wet pad 1100, the dry pad 1130, a hybrid wet-dry pad, and so forth. In embodiments, the aperture 1240 can be substituted with another type of indicator for communicating pad type information to a sensor or otherwise communicating with a controller of the robot 110. Such indicators include, for example, an RFID tag, a QR code or other data rich symbol, and so forth.

Figure 13:
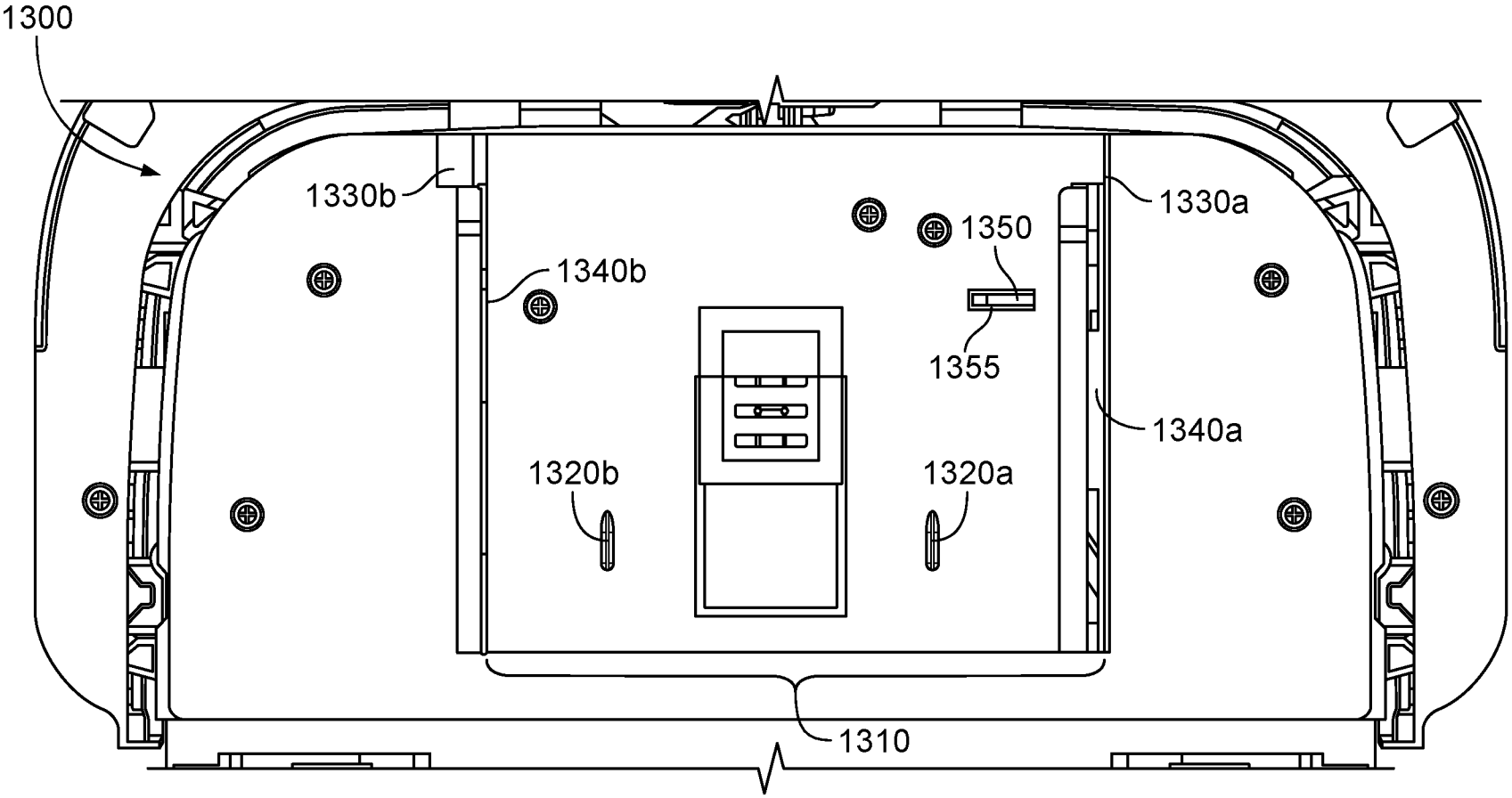
FIG. 13 is a bottom view of an exemplary pad holder on the robot.

The backing layer 1210 includes a pair of end stops 1260*a*, 1260*b* and a notch 1270 that assist the orientation and attachment of the pad 1200 to a pad holder of the robot 110 (e.g., pad holder 1300 of FIG. 13). The end stops 1260*a*, 1260*b* extend beyond the edges 1250*a*, 1250*b* of the backing layer 1210 on one end of the backing layer 1210 only so that the backing layer 1210 slide into a pair of retention rails (e.g., retainers 1340*a*, 1340*b* of FIG. 13) of the pad holder 1300 in only one orientation. This ensures that the leading edge 370, 590, 955 of the pad 300, 500, 900 is oriented toward the front of the robot 110. The end stops 1260*a*, 1260*b* fit correspondingly into recesses 1330*a*, 1330*b* in the pad holder 1300 on the robot. For example, the embodiment of the backing layer of FIG. 12 has a planar profile of a "T" shape and the end stops 1260*a*, 1260*b* form the top horizontal cross element of the "T". The top of the "T" of the backing layer 1210 cannot fit under the retainer rails 1340*a*, 1340*b* and the therefore the backing layer 1210 engages the pad holder 1300 in only a single orientation.

The notch 1270 depicted in the embodiment of the backing layer 1210 in FIG. 12 engages a spring loaded latch (not shown) under a retainer rail 1340*b* of the pad holder 1300 on the robot 110. The spring loaded latch is a detent (not shown) that holds the pad 1200 in place during operations of the mobile robot 110. The detent provides a user with haptic feedback to know when the backing layer 1210 has been fully and securely inserted into the pad holder 1300.

In some implementations, the pad 1200 includes one or more chemical preservatives applied to or manufactured within the backing layer 1210. The preservatives are selected to prevent the growth of wood spores that may be present in the wood based backing layer 1210. The backing layer is approximately 5-7 mm thick, 68-72 mm wide and 92-94 mm long. The backing layer 1210 is coated on both sides with a water resistant coating, such as wax or polymer or a combination of water resistant materials, such as wax, polyvinyl alcohol, polyamine. The backing layer 1210 does not disintegrate when wetted, such as by fluid wicked from the floor surface by the pad 1200.

To hold the backing layer 1210 of the pad 1200, the robot 110 includes a pad holder 1300. FIG. 13 is a bottom view of an example pad holder 1300 on the robot 110. The pad holder 1300 is attached to the cleaning robot 110 and is configured to secure any of the above described pads 300, 500, 900 to the robot 110. The pad holder 1300 includes a pad release mechanism 1310. The pad release mechanism is shown in an up or pad-secure position. The pad release mechanism 1310 includes a moveable retainer rail 1340*a*, (e.g., a lip) that holds the pad securely in place by supporting an edge (e.g., edges 1250*a-b*) of the backing layer 1210. The retainer rail 1340*b* is a moveable retention clip. In embodiments, toggling a toggle button moves a spring actuator that rotates the pad release mechanism 1310, moving the retention clip 1340 away from the backing layer 1210. In embodiments the toggle button is a pad release button located in the bumper on the front of the robot 110 or located on the top of the robot 110. In embodiments, the pad holder includes retractable protrusions 1320*a*, 1320*b* that retract into the pad holder 1300 when a pad release mechanism 1310 is activated. In embodiments, an ejector protrusion 1350 slides up through a slot 1352 or opening in the pad holder 1300. When the pad is to be ejected, the ejector protrusion 1350 extends through the slot 1355 and pushes against the backing layer 1210 to push the pad 300, 500, 900, 1200 from the pad holder 1300. a.

Under the weight of the robot 110, the pad holder 1300 is configured to apply varying pressure to the different portions of a pad (e.g., pad 500) against the floor surface (e.g., floor surface 310). The pad holder 1300 can apply more pressure to an aft portion (e.g., aft portion 320) of the pad 500 so that a forward portion (e.g., forward portion 330) of the pad does not adhere to the floor surface 310 and push debris in front of the pad 500 without entraining the debris. Rather, applying greater pressure to the aft portion of the pad 500 promotes even wetting and debris accumulation on the pad by allowing fluid and debris to pass beneath the forward portion 330 of the pad to contact the aft portion 320 of the pad 500.

In embodiments, the pad holder 1300 applies a greater pressure to a center of the aft portion 320 of the pad rather than edges 1295*a*, 1295*b* of the pad 500 which extend beyond the edges of the pad holder 1300. (Numbered elements refer to the single embodiment of the pad shown in FIGS. 3 and 5.) Because the pad holder does not extend beyond the width of the robot 110, the weight of the robot 110 rides directly on the portion of the pad 500 in contact with the pad holder 1300 but not the portions that extend beyond the pad holder 1300. The center of the pad 500 includes a portion of the pad 500 that is inwardly disposed from lateral edges 525, 535 of the pad 500. The lateral edges of the pad 500 are compliant. In embodiments, the lateral edges extend past the body of the robot 110 and can flex to ride up along walls or surfaces of other objects directly adjacent the robot 110. The pad holder 1300 applies an even pressure to the center of the aft portion 320 of the pad 500 so that the pad 500 collects debris evenly. Applying differential pressure to the center and edges of the pad promotes even wetting and debris accumulation on the pad 500 by allowing debris and fluid to pass beneath the pad 500 to the center of the pad 500. For example, when the robot 110 is turning, debris can pass sideways across a length of the pad 500 to the center of the pad 500 where it is collected by the pad 500, rather than being pushed by the side of the pad 500 and being left on the floor surface or accumulating only on edges of the pad 500. In embodiments, the center of the pad 500 is the 60-90 percent of the surface area of the pad 500 centered around a latitudinal axis 1290 (e.g., running forward-aft), inbound of the edges 1295*a*, 1295*b* and in contact with the floor surface 310. In embodiments, the center of the pad is located along a longitudinal axis 1280 spanning between the lateral (e.g., left and right) edges of the pad 500 and bisecting the pad 500.

Several implementations have been described above. Accordingly, other implementations are within the scope of the following claims.

What is claimed is:

1. A cleaning pad for an autonomous cleaning robot, the cleaning pad comprising:

a top portion engageable with the autonomous cleaning robot to mount the cleaning pad to the autonomous cleaning robot; and a pad body extending from a leading edge to a trailing edge of the pad body, the pad body configured to contact a floor surface as the autonomous cleaning robot to which the cleaning pad is mounted moves across the floor surface, wherein a first portion of the pad body has a thickness that tapers in a direction from the leading edge of the cleaning pad to the trailing edge of the cleaning pad.

2. The cleaning pad of claim 1, wherein the first portion of the pad body is a forward portion of the pad body.

3. The cleaning pad of claim 1, wherein the first portion of the pad body is configured to contact the floor surface with a first pressure as the autonomous cleaning robot to which the cleaning pad is mounted moves across the floor surface.

4. The cleaning pad of claim 3, wherein at least a second portion of the pad body is configured to contact the floor surface with a second pressure as the autonomous cleaning robot to which the cleaning pad is mounted moves across the floor surface, the second pressure being greater than the first pressure.

5. The cleaning pad of claim 4, wherein a width of the first portion is less than a width of the second portion.

6. The cleaning pad of claim 1, wherein the first portion of the pad body is configured to allow fluid and/or debris of the floor surface to contact at least a second portion of the pad body.

7. The cleaning pad of claim 6, wherein the second portion is configured to retain the debris from the floor surface within one or more transition regions of the second portion to at least partially clean the floor surface.

8. The cleaning pad of claim 6, wherein the second portion is configured to absorb the fluid from the floor surface into one or more layers of the second portion to at least partially clean the floor surface.

9. The cleaning pad of claim 1, wherein a width of the first portion is between 20% and 35% of a width of the pad body, and a width of the pad body is defined by a distance between the leading edge of the pad body and the trailing edge of the pad body.

10. The cleaning pad of claim 9, wherein the width of the first portion is about 25% of the width of the pad body.

11. The cleaning pad of claim 9, wherein the width of the first portion is about 33% of the width of the pad body.

12. The cleaning pad of claim 1, wherein the pad body has a width defined by a distance between the leading edge and the trailing edge between 10 and 15 cm and a length defined by a distance between two opposing lateral edges of the pad body between 27 and 32 cm.

13. The cleaning pad of claim 1, wherein the pad body has a width defined by a distance between the leading edge and the trailing edge between 5 and 10 cm and a length defined by a distance between two opposing lateral edges of the pad body between 15 and 20 cm.

14. Cleaning pads for an autonomous cleaning robot, the set of cleaning pads comprising:

a first cleaning pad engageable with the autonomous cleaning robot to mount the first cleaning pad to the autonomous cleaning robot, the first cleaning pad having a first cleaning pad type, wherein the first cleaning pad comprises an aft portion and a forward portion, the forward portion of the first cleaning pad having a thickness that is less than a thickness of the aft portion of the first cleaning pad; and a second cleaning pad engageable with the autonomous cleaning robot to mount the second cleaning pad to the autonomous cleaning robot, the second cleaning pad having a second cleaning pad type, wherein the second cleaning pad comprises an aft portion and a forward portion, the forward portion of the second cleaning pad having a thickness that is less than a thickness of the aft portion of the second cleaning pad, wherein a first ratio of a width of the forward portion of the first cleaning pad to a width of the aft portion of the first cleaning pad is different from a second ratio of a width of the forward portion of the second cleaning pad to a width of the aft portion of the second cleaning pad.

15. The cleaning pads of claim 14, wherein the first cleaning pad type is a wet pad configured to absorb a fluid or wet debris of a floor surface and the second cleaning pad type is a dry pad configured to retain dry debris of the floor surface.

16. The cleaning pads of claim 15, wherein the first ratio is less than the second ratio.

17. The cleaning pads of claim 16, wherein the first ratio is between 20% and 30% and the second ratio is between 25% and 35%.

18. The cleaning pads of claim 15, wherein:

the forward portion of the first cleaning pad type is configured to allow the fluid or wet debris of the floor surface to contact the aft portion of the first cleaning pad type, and the forward portion of the second cleaning pad type is configured to allow the dry debris of the floor surface to contact the aft portion of the second cleaning pad type.

19. A system comprising:

the first cleaning pad of claim 14;

the second cleaning pad of claim 14; and the autonomous cleaning robot of claim 14.

20. The system of claim 19, wherein the autonomous cleaning robot is configured to:

determine when the first cleaning pad is mounted to the autonomous cleaning robot based on a first indicator of the first cleaning pad, the first indicator being indicative of the first cleaning pad type; and determine when the second cleaning pad is mounted to the autonomous cleaning robot based on a second indicator of the second cleaning pad, the second indicator being indicative of the second cleaning pad type.

21. The system of claim 20, wherein the first indicator comprises a first tag or code, and the second indicator comprises a second tag or code.

22. The system of claim 20, wherein the first indicator is defined by a first shape of a first backing layer of the first cleaning pad, and the second indicator is defined by a second shape of a second backing layer of the second cleaning pad.

23. An autonomous cleaning robot comprising:

a robot body;

a drive system to maneuver the robot body across a floor surface;

a cleaning assembly affixed to the robot body, the cleaning assembly comprising a pad holder; and a cleaning pad removably mounted to the pad holder of the cleaning assembly, the cleaning pad comprising:

a top portion engageable with the pad holder of the cleaning assembly to mount the cleaning pad to the autonomous cleaning robot; and a pad body extending from a leading edge to a trailing edge of the pad body, the pad body configured to contact the floor surface as the autonomous cleaning robot to which the cleaning pad is mounted moves across the floor surface, wherein at least a portion of the pad body has a thickness that tapers in a direction from the leading edge of the cleaning pad to the trailing edge of the cleaning pad.

24. The autonomous cleaning robot of claim 23, wherein the drive system is configured to maneuver the robot body across the floor surface to retain debris of the floor surface with one or more transition regions of the pad body.

25. The autonomous cleaning robot of claim 23, wherein the drive system is configured to maneuver the robot body across the floor surface to absorb fluids of the floor surface with one or more layers of the pad body.

26. The autonomous cleaning robot of claim 23, wherein the portion of the pad body is a forward portion of the pad body.

27. The autonomous cleaning robot of claim 26, wherein a width of the forward portion of the pad body is between 20% and 35% of a width of the pad body.

28. The autonomous cleaning robot of claim 27, wherein the width of the forward portion is defined by a distance between (i) a leading edge of the forward portion and (ii) a common edge of the forward portion and an aft portion of the pad body, and the width of the pad body is defined by a distance between (i) the leading edge of the pad body and (ii) the trailing edge of the pad body.

* * * * *